US007970308B2

(12) United States Patent
Sugiyama

(10) Patent No.: US 7,970,308 B2
(45) Date of Patent: Jun. 28, 2011

(54) IMAGE FORMING APPARATUS WITH LOOP CORRECTING DEVICE

(75) Inventor: Norikazu Sugiyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 12/396,764

(22) Filed: Mar. 3, 2009

(65) Prior Publication Data

US 2009/0226198 A1 Sep. 10, 2009

(30) Foreign Application Priority Data

Mar. 6, 2008 (JP) ..... 2008-056329

(51) Int. Cl.
*G03G 15/16* (2006.01)

(52) U.S. Cl. ..... 399/66; 399/301

(58) Field of Classification Search ..... 399/66, 399/302, 303, 308, 301, 162
See application file for complete search history.

(56) References Cited

U.S. PATENT DOCUMENTS

| | | | | |
|---|---|---|---|---|
| 4,941,021 | A | 7/1990 | Uchida et al. | 399/322 |
| 5,450,180 | A | 9/1995 | Ohzeki et al. | 399/50 |
| 6,301,451 | B1 * | 10/2001 | Ando et al. | 399/301 |
| 6,708,017 | B2 | 3/2004 | Yamanaka et al. | 399/301 |
| 6,892,038 | B2 | 5/2005 | Fukutani | 399/68 |
| 6,909,859 | B2 | 6/2005 | Nakamura et al. | 399/50 |
| 7,426,353 | B1 | 9/2008 | Sakakibara | 399/68 |
| 2006/0051116 | A1 | 3/2006 | Koshida | 399/68 |
| 2006/0120744 | A1 | 6/2006 | Shirakata et al. | 399/68 |
| 2006/0222386 | A1 | 10/2006 | Koshida et al. | 399/44 |
| 2006/0222394 | A1 | 10/2006 | Koshida | 399/68 |
| 2006/0251439 | A1 | 11/2006 | Sugiyama | 399/68 |
| 2007/0147894 | A1 * | 6/2007 | Yokota | 399/302 |
| 2007/0264033 | A1 | 11/2007 | Koshida | 399/16 |

FOREIGN PATENT DOCUMENTS

| | | | |
|---|---|---|---|
| JP | 2-123385 | A | 5/1990 |
| JP | 05-107966 | A | 4/1993 |
| JP | 10-260567 | A | 9/1998 |
| JP | 11-143249 | A | 5/1999 |
| JP | 2000-19860 | A | 1/2000 |
| JP | 2000-352850 | A | 12/2000 |
| JP | 2001-228777 | A * | 8/2001 |
| JP | 2002-23512 | A | 1/2002 |
| JP | 2002-328576 | A | 11/2002 |
| JP | 3388535 | B2 | 3/2003 |
| JP | 2003-316184 | A | 11/2003 |
| JP | 2006-259637 | A | 9/2006 |
| JP | 2008-145680 | A | 6/2008 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus of the present invention includes an image bearing member for carrying a toner image, a rotatable endless belt, a transfer member for transferring a toner image from the image bearing member onto the endless belt electrostatically, a detecting device to detect a distance from the endless belt, and controls amount a loop generated in the belt to the predetermined loop amount, based on the distance detected by the detecting device.

13 Claims, 18 Drawing Sheets

V : PRIMARY TRANSFER BIAS
R : PRIMARY TRANSFER SHEET RESISTANCE VALUE
I : CURRENT VALUE OF PRIMARY TRANSFER SHEET
E : ELECTRIC FIELD
F : PRIMARY TRANSFER ELECTROSTATIC ATTRACTION FORCE
μ : DYNAMIC FRICTION COEFFICIENT
N : NORMAL FORCE
F ′ : LOAD OF PRIMARY TRANSFER PORTION

IMAGE FORMING APPARATUS WITH LOOP CORRECTING DEVICE

BACKGROUND OF THE INVENTION

1. Field of the Invention

The present invention relates to an electrophotographic image forming apparatus such as a printer, copier and the like.

2. Description of the Related Art

Conventionally, as an image forming apparatus such as a copier or a printer using the electrophotographic system, there has been known an intermediate transfer type image forming apparatus using an intermediate transfer belt. The intermediate transfer type image forming apparatus can form color images (multiple image) on a sheet by means of a primary transfer process and a secondary transfer process. Additionally, there has been known another image forming apparatus which has a sheet conveying belt for conveying the sheet so as to transfer a toner image onto the sheet carried by the sheet conveying belt.

For example, Japanese Patent Application Laid-Open No. 2002-23512 has proposed an art for controlling the bias of a transfer means based on a result of detection of the impedance of the transfer means for such an image forming apparatus.

There is still another method in which the impedance of the entire transfer portion is detected by a constant current control before a recording material 211 reaches a transfer region and based on that detection result, a voltage applied to a transfer member for transferring a developing agent, when a recording material 211 reaches a transfer region, is controlled to a constant level. This constant voltage control method is called active transfer voltage control (ATVC) method hereinafter.

As the method for controlling a voltage applied to this transfer member, for example, Japanese Patent Application Laid-Open No. 02-123385 has proposed a control method in which a constant current is applied to the transfer portion in a predetermined time period, and a voltage calculated and determined based on a preliminarily set control equation and a voltage generated at that time is applied to the sheet if the transfer member exists.

However, when the transfer sheet is used as a transfer member as shown in FIG. 16, there exists the following inconvenience. FIG. 16 shows a view for explaining a load applied to a primary transfer portion of an image forming apparatus having the intermediate transfer body. FIG. 16 shows a portion around the primary transfer portion. Reference numeral 222 denotes a photosensitive drum, which carries a toner image, and reference numeral 228 denotes an intermediate transfer belt to which the toner image is to be transferred from the photosensitive drum 222. Reference numeral 227 denotes a primary transfer sheet which executes primary transfer of the toner image from the photosensitive drum 222 to the intermediate transfer belt 228. If an image formation operation of the image forming apparatus is executed for a long period, the primary transfer sheet 227 is worn by friction on the intermediate transfer belt 228. As a result, a resistance value R of the primary transfer sheet 227 is increased.

Because a current supplied to the transfer portion which is the primary transfer sheet 227 is controlled to a constant level under the above-described ATVC control, a voltage V applied to the primary transfer sheet is increased according to following Ohm's law as the resistance value R of the primary transfer sheet 227 is increased.

$$V=R\times I \tag{1-1}$$

Where V is the value of a voltage (primary transfer bias) to be applied for the primary transfer, R is a resistance value of the primary transfer sheet 227 and I is the value of a current supplied to a primary transfer sheet 227.

When the primary transfer bias V is increased as described above, a primary transfer electrostatic attraction force F between the intermediate transfer belt 228 and the primary transfer sheet 227, generated in the primary transfer portion is increased according to the following Coulomb's law.

$$F=q\times E \tag{1-2}$$

Where F is a primary transfer electrostatic attraction force acting in a direction in which the primary transfer sheet 227 adsorbs the intermediate transfer belt 228, and q is a charge amount defined as $1.6\times10^{-19}$ [C (Coulomb)]. E means an electric field which is generated in a direction to the primary transfer sheet 227 from the photosensitive drum with an application of the primary transfer bias.

Thus, as the primary transfer electrostatic attraction force F is increased, a primary transfer portion load F' generated in the primary transfer portion is increased according to the following equation.

$$F'=\mu\times N \tag{1-3}$$

F' means a primary transfer portion load acting in an opposite direction to a transfer direction of the intermediate transfer belt 228, μ means a dynamic friction coefficient generated between the primary transfer sheet 227 and the intermediate transfer belt 228 and N means a normal force acting in an opposite direction to the primary transfer electrostatic force. The normal force mentioned here is a force having the same magnitude as the primary electrostatic attraction force F.

FIG. 15 is a diagram for explaining changes of load torque of the intermediate transfer belt 228 with a durable drive of a color image forming apparatus. That is, the primary transfer portion load F' described in FIG. 16 is increased with executing the image formation operation durably. As a result, a load torque of the intermediate transfer belt 228 is increased.

Generally, the following relation needs to be established between the drive torque $T_m$ of a drive motor (not shown) which drives the intermediate transfer belt 228 and the load torque T of the intermediate transfer belt 228, so as to drive the intermediate transfer belt 228 by drive motor.

$$T_m \geqq T \tag{1-4}$$

However, as a result of the durable execution of the image formation operation described above, the primary transfer portion load F' is increased, so that the load torque T of the intermediate transfer belt 228 is also increased.

As a result, the following relation sometimes occurs.

$$T_m < T \tag{1-5}$$

FIG. 17 is a sectional view of the image forming apparatus when the image formation operation of the image forming apparatus having the primary transfer sheet is executed durably. Reference numeral 236*b* denotes a driven roller which is driven to convey an intermediate transfer belt 228 when the image formation operation is executed durably. Here, consider a case where the load torque T of the intermediate transfer belt 228 becomes larger than the drive torque $T_m$ of a drive motor (not shown) by the durable image formation operation as indicated by the equation (1-5).

In this case, a loop is generated in the intermediate transfer belt 228 located between a drive roller 237 and the primary transfer portion disposed on the uppermost stream side of the intermediate transfer belt 228.

Because the entire peripheral length of the intermediate transfer belt 228 is not changed (not expanded or contracted), a driven roller 236 disposed in the downstream of the primary transfer portion in the lowest downstream is pulled to the drive roller side so that it is moved to a position indicated by reference numeral 236*b* shown in FIG. 17.

When the image formation operation of the image forming apparatus is executed durably as described above, a loop can be generated in the intermediate transfer belt 228. Consequently, a color deviation due to the loop of the intermediate transfer belt 228 can be generated or a defective image forming can be generated due to a contact of a loop of the intermediate transfer belt 228 with any member in the image forming apparatus. Additionally, sometimes, a scratch or damage occurs in the intermediate transfer belt 228 thereby reducing the service life of the image forming apparatus.

The degree of the above-mentioned loop does not depend on the conveying velocity of the intermediate transfer belt 228. The reason is that it has been known that the coefficient of dynamic friction μ does not depend on the conveying velocity largely as a natural law. As a countermeasure for generation of the loop in the intermediate transfer belt 228, use of a member composed of the material and configuration having a low dynamic friction coefficient μ as a member for the primary transfer can be mentioned.

However, such a countermeasure generates an extreme increase in cost of manufacturing any member relating to the primary transfer, for example, by several times to ten and several times.

The above-described problem occurs in an image forming apparatus using a sheet conveying belt also.

SUMMARY OF THE INVENTION

An object of the present invention is to provide an image forming apparatus including an image bearing member on which a toner image is formed and a transfer member for transferring the toner image formed on the image bearing member to an intermediate transfer belt or a sheet conveyed by a sheet conveying belt, the image forming apparatus being capable of eliminating a loop in the intermediate transfer belt originating from a load torque of a primary transfer portion.

Another object of the present invention is to provide an image forming apparatus, comprising: an image bearing member for carrying a toner image; a rotatable endless belt; a drive roller which supports the endless belt and rotates the endless belt; a transfer member for transferring a toner image from said image bearing member onto the endless belt or a sheet conveyed by the endless belt electrostatically; a detecting device which is opposed to the endless belt so as to detect a distance from said endless belt; and a loop correcting device for controlling a loop generated in the endless belt to a predetermined loop amount, wherein the loop correcting device controls the loop of the endless belt to the predetermined loop amount based on the distance detected by the detecting device.

Still another object of the present invention is to provide an image forming apparatus, comprising: an image bearing member for carrying a toner image; a rotatable intermediate transfer belt to which the toner image is transferred from the image bearing member; a drive roller which supports the intermediate transfer belt and rotates the intermediate transfer belt; a primary transfer member which is loaded with a voltage so as to transfer the toner image primarily from the image bearing member to the intermediate transfer belt in the primary transfer portion; a secondary transfer member which is loaded with a voltage so as to transfer the toner image secondarily from the intermediate transfer belt to a sheet in the second transfer portion; a power supply circuit for applying a voltage to the primary transfer member; a primary transfer voltage control device for controlling a voltage which the power supply circuit applies to the primary transfer member; and a detecting device which is opposed to the intermediate transfer belt so as to detect a distance from the intermediate transfer belt, wherein the primary transfer voltage control device controls a voltage which the power supply circuit applies to the primary transfer member based on a distance detected by the detecting device.

Still another object of the present invention is to provide an image forming apparatus, comprising: an image bearing member for carrying a toner image; a rotatable sheet conveying belt for conveying a sheet to which the toner image is transferred from the image bearing member; a drive roller which supports the sheet conveying belt and rotates the sheet conveying belt; a transfer member which is loaded with a voltage so as to transfer the toner image from the image bearing member to the sheet carried by the sheet conveying belt; a power supply circuit for applying a voltage to the transfer member; a transfer voltage control device for controlling the voltage which the power supply circuit applies to the transfer member; and a detecting device which is opposed to the sheet conveying belt so as to detect a distance from the sheet conveying belt, wherein the transfer voltage control device controls the voltage which the power supply circuit applies to the transfer member based on a distance detected by the detecting device. Further features of the present invention will become apparent from the following description of exemplary embodiments with reference to the attached drawings.

DETAILED DESCRIPTION OF THE PREFERRED EMBODIMENTS

Hereinafter, preferred embodiments of the present invention will be described in detail with reference to the accompanying drawings. The dimension, material, shape and arrangement of components described in the embodiments below should be changed appropriately depending on the configuration and various conditions of the apparatus to which the present invention is applied. Therefore, the scope of the present invention is not restricted to only those components unless otherwise specified.

First Embodiment

Figure 2:
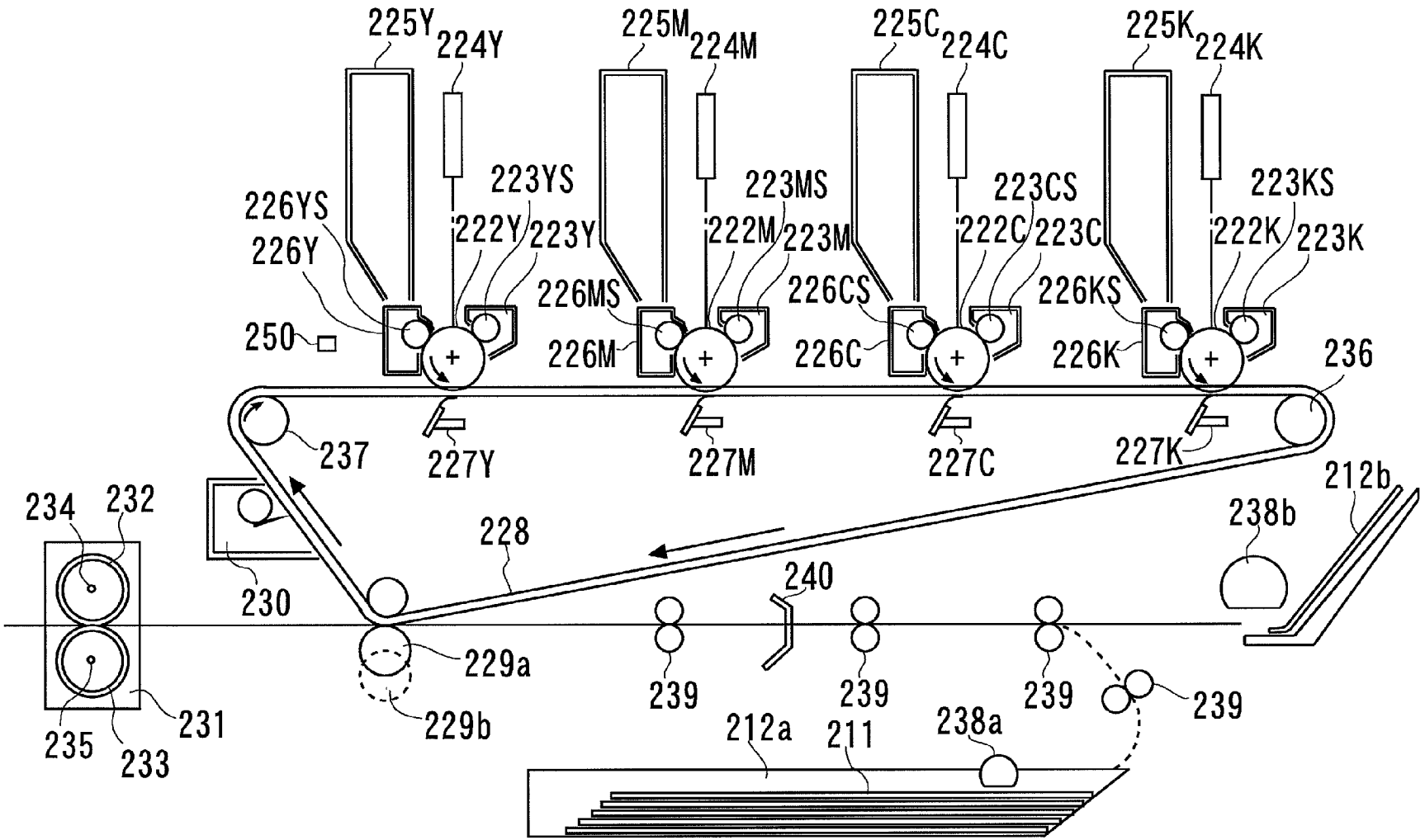
FIG. 2 is a sectional view of a tandem type image forming apparatus employing the intermediate transfer belt which is an example of the electrophotographic image forming apparatus according to the first embodiment of the present invention.

Hereinafter, the first embodiment of the present invention will be described. FIG. 2 shows an example of the electrophotographic color image forming apparatus to which the present invention can be applied, equipped with image forming means for yellow Y, magenta M, cyan C and black K. This is an example of the electrophotographic color image forming apparatus or a tandem type color image forming apparatus employing the intermediate transfer belt 228 as its intermediate transfer body.

An image formation operation of the electrophotographic image forming apparatus will be described with reference to FIG. 2. Reference numeral 211 denotes a recording material, reference numeral 212*a* denotes a paper feed cassette which holds the recording materials and reference numeral 212*b* denotes a paper feeding tray which holds the recording materials like the paper feeding cassette 212*a*. Reference numerals 222Y, 222M, 222C, 222K denote photosensitive drums (Y, M, C, and K indicate yellow Y, magenta M, cyan C, and black K respectively) for forming latent images (electrostatic latent image). Reference numerals 223Y, 223M, 223C, 223K denote injection chargers for charging the photosensitive drums 222Y, 222M, 222C, and 222K. Reference numerals 224Y, 224M, 224C, and 224K denote laser scanners for forming a latent image (electrostatic latent image) optically. Reference numerals 225Y, 225M, 225C, and 225K denote toner containers for feeding toner of each color to development units. Reference numerals 226Y, 226M, 226C, and 226K denote development units for visualizing the electrostatic latent image as a toner image. The image forming means is constituted of the photosensitive drums, injection chargers, laser scanners and development units. Reference numeral 228 denotes an intermediate transfer belt which serves as an endless belt shaped intermediate transfer body for holding the toner image. Reference numeral 237 denotes a drive roller which is rotated to convey and drive the intermediate transfer belt. Reference numeral 236 denotes a driven roller which is driven to convey the intermediate transfer belt.

Reference numerals 227Y, 227M, 227C, and 227K denote primary transfer members for transferring a toner image to the intermediate transfer belt (endless belt) 228. The primary transfer member of this embodiment is a primary transfer sheet. By applying a voltage to the primary transfer sheet from a power supply circuit (not shown), the toner image can be transferred to the intermediate transfer belt (endless belt) 228. When a voltage is applied, the primary transfer sheet is adsorbed electrostatically to the intermediate transfer belt 228, making a sliding contact with the intermediate transfer belt 228 without being rotated. A transfer voltage control device controls a voltage applied to the primary transfer sheet by the power supply circuit.

Reference numerals 229*a* and 229*b* denote a secondary transfer roller for transferring the toner image on the intermediate transfer belt 228 to the recording material 211. Reference numeral 230 denotes a cleaning portion for cleaning off toner left on the intermediate transfer belt 228. Reference numeral 231 denotes a fixing portion for fixing the toner image to the recording material by melting. Reference numeral 232 denotes a fixing roller, reference numeral 233 denotes a pressure roller for pressing the recording material 211 to the fixing roller 232 and reference numerals 234 and 235 denote heaters for heating the fixing roller 232 and the pressure roller 233. Reference numerals 238*a* and 238*b* denote paper feeding rollers for feeding the recording material 211, reference numeral 239 denotes conveying rollers for conveying the recording material 211 to the secondary transfer rollers 229*a* and 229*b* in a sandwiched state, and reference numeral 240 denotes a conveying sensor for detecting a passage of the recording material 211.

The laser scanners 224Y, 224M, 224C, and 224K project an exposure light corresponding to an exposure time processed by a data control portion (not shown) so as to form an electrostatic latent image. This electrostatic latent image is developed by the development units 226Y, 226M, 226C, and 226K for each color so as to form a single-color image on each of the photosensitive drums 222Y, 222M, 222C and 222K. By superimposing the single-color images on the intermediate transfer belt 228, a multicolor toner image is formed. After that, this multicolor toner image is transferred to the recording material 211 and then, the multicolor toner image on the recording material 211 is fixed by the fixing portion 231.

The charging portion is constituted of four injection chargers 223Y, 223M, 223C, and 223K for charging the photosensitive drums 222Y, 222M, 222C, and 222K at each station for yellow Y, magenta M, cyan C and black K. The respective injection chargers include charging rollers 223YS, 223MS, 223CS, and 223KS.

The photosensitive drums 222Y, 222M, 222C, and 222K are constructed by coating the outer periphery of each aluminum cylinder with organic photoconductive layer and rotated by a drive force transmitted from a drive motor (not shown). The drive motors rotate the photosensitive drums 222Y, 222M, 222C, 222K in a counterclockwise direction corresponding to an image formation operation.

The exposing portion serving as an exposing means projects an exposure light to the photosensitive drums 222Y, 222M, 222C, and 222K by means of the laser scanners 224Y, 224M, 224C, and 224K. By exposing the surface of the photosensitive drums 222Y, 222M, 222C, and 222K selectively, an electrostatic latent image is formed.

The developing portion which serves as a developing means includes four development units 226Y, 226M, 226C, and 226K for developing yellow Y, magenta M, cyan C, black K at each station. Each of the development units is provided with the developing rollers 226YS, 226MS, 226CS, and 226KS. In the meantime, the respective development units 226Y, 226M, 226C, and 226K are attachable/detachable.

By applying an appropriate voltage (hereinafter referred to as primary transfer voltage) to the primary transfer sheets 227Y, 227M, 227C, and 227K, the toner image is transferred to the intermediate transfer belt 228. Further, by providing the rotation velocity of the photosensitive drums 222Y, 222M, 222C, and 222K and the rotation velocity of the intermediate transfer belt 228 with a difference, the single-color toner image is transferred to the intermediate transfer belt 228 more efficiently. This is called a primary transfer and this transfer portion is called primary transfer portion. The drive roller 237 is rotated in a clockwise direction by a drive force transmitted from a drive motor (not shown).

The transfer portion superimposes the single-color toner image of each station on the intermediate transfer belt 228 and the multicolor toner image produced by the superimposing is carried to the secondary transfer roller 229*a* with a rotation of the intermediate transfer belt 228. The recording material 211 is fed from the paper feeding cassette 212*a* by the paper feeding roller 238*a* and carried to the secondary transfer roller 229*a* by the group of the carrying rollers 239 in a sandwiched state, so that the multicolor toner image on the intermediate transfer belt 228 is transferred to the recording material 211. At this time, by applying an appropriate bias to the secondary transfer roller 229*a*, the toner image is transferred electrostatically. This is called secondary transfer and this portion is called a secondary transfer portion.

The fixing portion has the fixing roller 232 for heating the recording material 211 and the pressure roller 233 for pressing the recording material 211 to the fixing roller 232 in order to fix the multicolor toner image transferred to the recording material 211 to the recording material 211 by melting. The fixing roller 232 and the pressure roller 233 are formed in a hollow structure and incorporate heater 234, 235 internally. The fixing portion 231 carries the recording material 211 holding the multicolor toner image by means of the fixing roller 232 and the pressure roller 233 and applies heat and pressure to fix the toner to the recording material 211.

After toner is fixed, the recording material 211 is discharged to a discharge tray (not shown) by means of a discharge roller (not shown). As a result, the image formation operation is ended.

The cleaning portion 230 cleans off toner left on the intermediate transfer belt 228 and waste toner left after the four-color, multicolor toner image formed on the intermediate transfer belt 228 is transferred to the recording material 211 is accumulated in a cleaner container (not shown). In this embodiment, a detecting device is disposed above the drive roller 237 for driving the intermediate transfer belt 228 by a rotating operation such that it is opposed to the intermediate transfer belt 228. In this embodiment, the detecting device is a distance detection sensor 250 so as to detect a distance between the intermediate transfer belt 228 and the sensor (correspond to the position of the endless belt).

Figure 3:
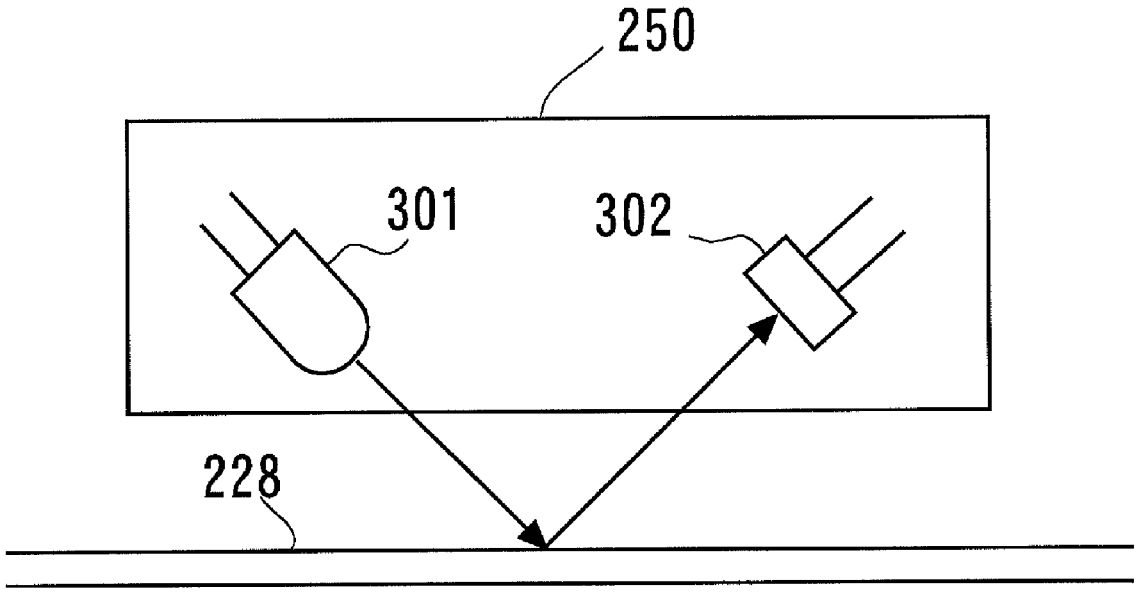
FIG. 3 is a view for explaining an example of the configuration of a distance detection sensor according to the first embodiment of the present invention.

FIG. 3 is a view for explaining an example of the configuration of the detecting device. The distance detection sensor 250 is constituted of a light emitting device 301 like an LED, a light receiving device 302 like a photo diode, a semiconductor integrated circuit (hereinafter referred to as IC) (not shown) which processes received light data and a holder (not shown) which accommodates these components. Light emitted from the light emitting device 301 is reflected by the intermediate transfer belt 228 and impinges upon the light receiving device 302. The light receiving device 302 detects the intensity of reflection light from the intermediate transfer belt 228.

Although FIG. 3 shows the configuration for detecting a normal reflection light, the distance detection sensor 250 is not limited to that configuration but may detect a diffused reflection light from the intermediate transfer belt 228. In the meantime, it is permissible to use an optical device such as a lens (not shown) to couple the light emitting device 301 with the light receiving device 302. In this embodiment, the distance detection sensor 250 will be described as the configuration for detecting the normal reflection light described in FIG. 3.

Figure 4:
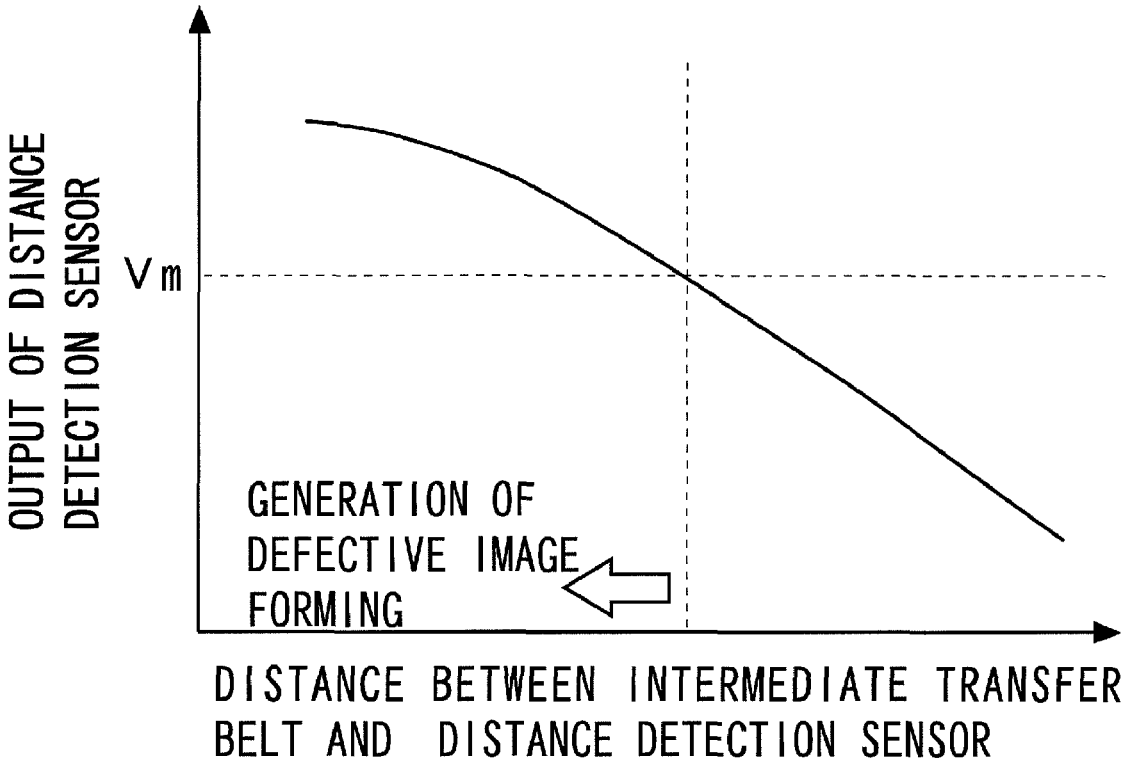
FIG. 4 is a diagram for explaining the output characteristic of the distance detection sensor according to the first embodiment of the present invention.

FIG. 4 is a diagram for explaining the output characteristic of the distance detection sensor 250. The output of the distance detection sensor 250 having the configuration for detecting the normal reflection light is increased as the intermediate transfer belt 228 approaches the distance detection sensor 250 and is decreased as the intermediate transfer belt 228 leaves the distance detection sensor 250. When a distance between the intermediate transfer belt 228 and the distance detection sensor 250 is smaller, the loop in the intermediate transfer belt 228 is larger, and when the distance between the intermediate transfer belt 228 and the distance detection sensor 250 is larger, the loop in the intermediate transfer belt 228 is smaller. In this embodiment, as an example, the output value of the distance detection sensor 250 as a threshold under which the loop in the intermediate transfer belt 228 is increased so as to generate an defective image forming is defined as Vm.

Figure 5:
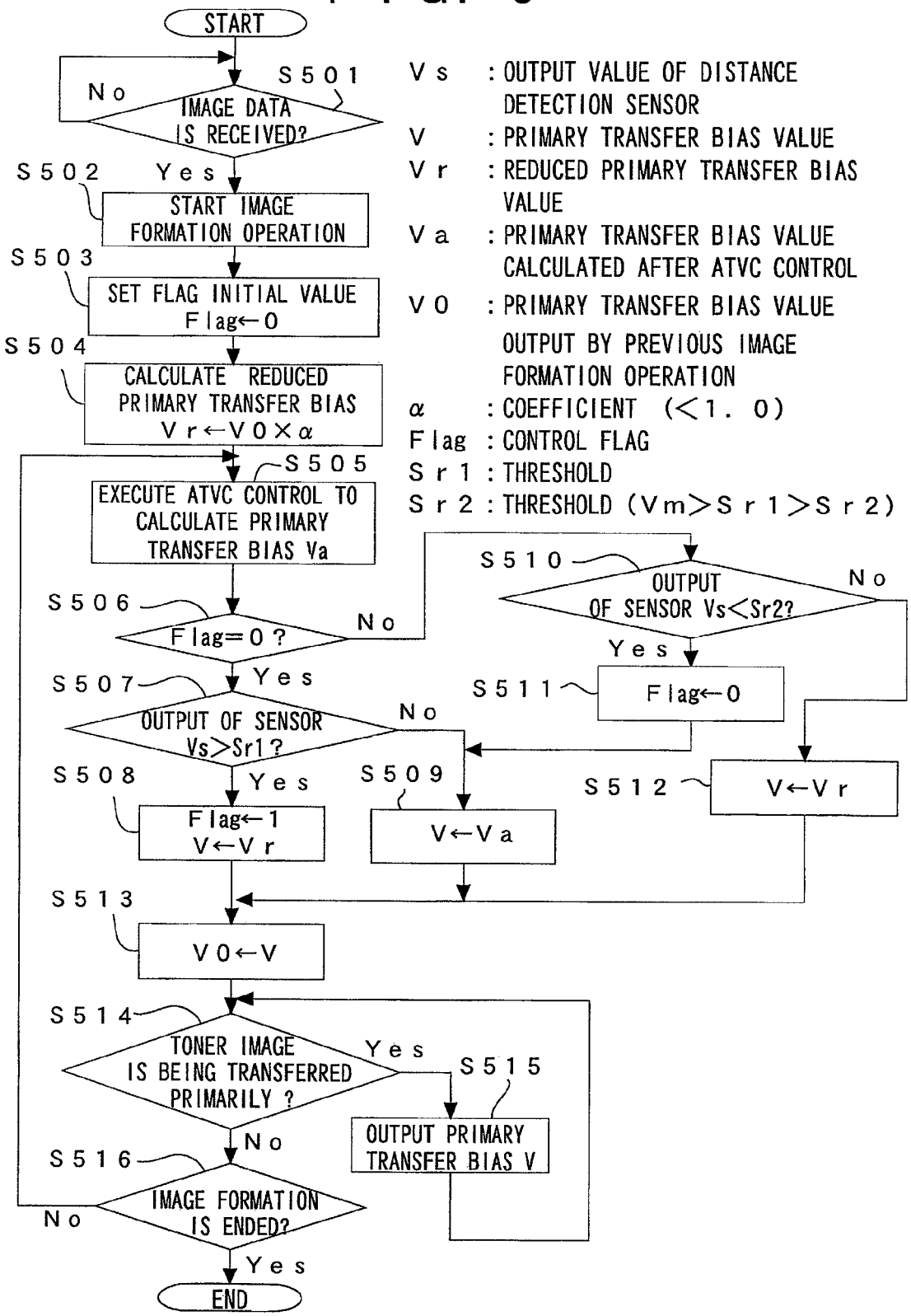
FIG. 5 is a flowchart for explaining an operation of primary transfer bias control according to the first embodiment of the present invention.

FIG. 5 is a flow chart for explaining an operation of the primary transfer bias control to which the present invention can be applied. In step 501 (hereinafter expressed as S501 and other steps are expressed in the same way), whether or not image data from a video controller or the like (not shown) is received by a controller (not shown) is determined. If it is determined that no image data is received, the procedure is returned to before the processing of S501. Here, the processing of S501 is executed repeatedly until it is determined that the image data is received in S501. If it is determined that the image data is received in S501, the procedure proceeds to S502.

In S502, the image formation operation is started when the controller receives the image data. At that time, papers loaded in the paper feed cassette 212*a* or the paper feed tray 212*b*, which is a paper feed port specified by the video controller or the control panel, are fed by the paper feed roller 238*a* or 238*b*. When the processing of S502 is ended, the procedure proceeds to S503.

In S503, the data control portion having a transfer voltage control device (not shown) sets a control flag for use for the primary transfer bias control to an initial value 0. The control flag is set to 0 or 1 and memorized in a memory (not shown) and then, the data control portion communicates so as to update the flag condition as required. When the processing of S503 is ended, the procedure proceeds to S504.

In S504, a reduced primary transfer bias Vr is calculated. The reduced primary transfer bias Vr is calculated according to the following equation.

$$Vr=V0\times\alpha(0<\alpha<1.0) \quad (2\text{-}1)$$

Where V0 is a primary transfer bias value output by the image formation operation and a is a reduction coefficient. So as to reduces the primary transfer electrostatic attraction force to be lower than the primary transfer electrostatic attraction force F at the time of ATVC control, a is set to a range of $0<\alpha<1.0$. Although $\alpha$ can be set arbitrarily, $\alpha=0.8$ is assumed as an example of this embodiment. Consequently, the reduced primary transfer bias Vr is a value 80% of the primary transfer bias value output by the previous image formation operation. When the processing of S504 is ended, the procedure proceeds to S505.

In S505, the ATVC control is executed to calculate a primary transfer bias Va. Because the detail of the ATVC control is the same as described in the section of the prior art, description thereof will not be repeated here. When the processing of S505 is ended, the procedure proceeds to S506.

In S506, whether or not the state of the control flag is 0 is determined. If an affirmative determination is made, the procedure proceeds to S507. On the other hand, if a negative determination is made, the procedure proceeds to S510.

In S507, whether or not an output Vs of the distance detection sensor 250 is larger than Sr1 is determined depending on that the state of the control flag is 0. That is, the data control portion has a loop amount determining device and the loop amount determining device determines the loop amount of the intermediate transfer belt 228 based on a distance detected by the distance detection sensor 250.

Sr1 is a threshold set preliminarily. In order to detect an increase of the loop amount in the intermediate transfer belt 228, Sr1 is set in a range smaller than the output value Vm (Vm>Sr1) of the distance detection sensor 250 when a loop of a lower limit which can generate any defective image forming exists on the intermediate transfer belt 228. If an affirmative determination is made, the procedure proceeds to S508. On the other hand, if a negative determination is made, the procedure proceeds to S509.

In S508, the control flag is set to 1 and the primary transfer bias V is set to a reduced primary transfer bias Vr in order to reduce the load torque of the intermediate transfer belt 228. This is because the load torque of the intermediate transfer belt 228 is increased because the output Vs of the distance detection sensor 250 is larger than Sr1, and the loop amount of the intermediate transfer belt 228 is increased so that it is determined that a current condition is just before any defective image forming occurs. By outputting the primary transfer bias on a lower level than an arithmetic operating result Va of the ATVC control, the primary transfer electrostatic attraction force and the primary transfer portion load are reduced and consequently, the load torque of the intermediate transfer belt 228 is reduced. When the processing of S508 is ended, the procedure proceeds to S513.

In S513, the value of the primary transfer bias V set in S508 is memorized as the primary transfer bias V0 output by the previous image formation operation. When the processing of S513 is ended, the procedure proceeds to S514.

On the other hand, in S509, the primary transfer bias V is set to the primary transfer bias Va calculated by the ATVC control in order to terminate the load torque reduction control of the intermediate transfer belt 228. The reason is that because the output Vs of the distance detection sensor 250 is Sr1 or less, it is determined that the loop of the intermediate transfer belt 228 is eliminated, that is, the load torque of the intermediate transfer belt 228 is reduced sufficiently. When the processing of S509 is ended, the procedure proceeds to S513, in which the primary transfer bias V set in S509 is memorized as the primary transfer bias V0 output by the previous image formation operation, as described previously. When the processing of S513 is ended, the procedure proceeds to S514.

When the state of the control flag is 1 in S510 (NO in S506), whether or not the output Vs of the distance detection sensor 250 is smaller than Sr2 is determined. Here, Sr2 is a threshold set preliminarily, which is set in a range lower than the threshold Sr1 for determining a possibility of an increase in the loop amount of the intermediate transfer belt 228 (Vm>Sr1>Sr2) in order to detect that the loop of the intermediate transfer belt 228 is eliminated sufficiently. If an affirmative determination is made in S510, the procedure proceeds to S511. On the other hand, if a negative determination is made in S510, the procedure proceeds to S512.

When the output Vs of the distance detection sensor 250 is Sr2 or more (NO in S510), it is determined that the reduction control of the load torque of the intermediate transfer belt 228 should be continued and the primary transfer bias V is set to the reduced primary transfer bias Vr in S512. After that, the procedure proceeds to S513. The content of the processing of S513 is as described above. When the processing of S513 is ended, the procedure proceeds to S514.

In S511, the control flag is set to 0 in order to terminate the reduction control of the load torque of the intermediate transfer belt 228. This is because it is determined that the load torque of the intermediate transfer belt 228 is reduced sufficiently when the output Vs of the distance detection sensor 250 is smaller than Sr2 (YES in S510).

After that, the primary transfer bias V is set to the bias voltage Va calculated by the ATVC control in S509. After that, the procedure proceeds to step S513 and when the processing of S513 is ended, the procedure proceeds to S514.

In S514, whether or not the toner image is being transferred primarily to the intermediate transfer belt 228 in the image forming apparatus is determined. If an affirmative determination is made, the procedure proceeds to S515. On the other hand, if a negative determination is made, the procedure proceeds to S516. In S515, the set primary transfer bias V is outputted to the transfer portion because the toner image is being transferred to the intermediate transfer belt 228 primarily (YES in S514).

On the other hand, when the toner image is not being transferred to the intermediate transfer belt 228 primarily in S516 (NO in S514), whether or not the image formation is ended is determined. If the affirmative determination is made here, the flow chart is terminated and the procedure is returned to start of this flow chart (S501). On the other hand, if a negative determination is made, the procedure is returned to before S505.

Figure 1:
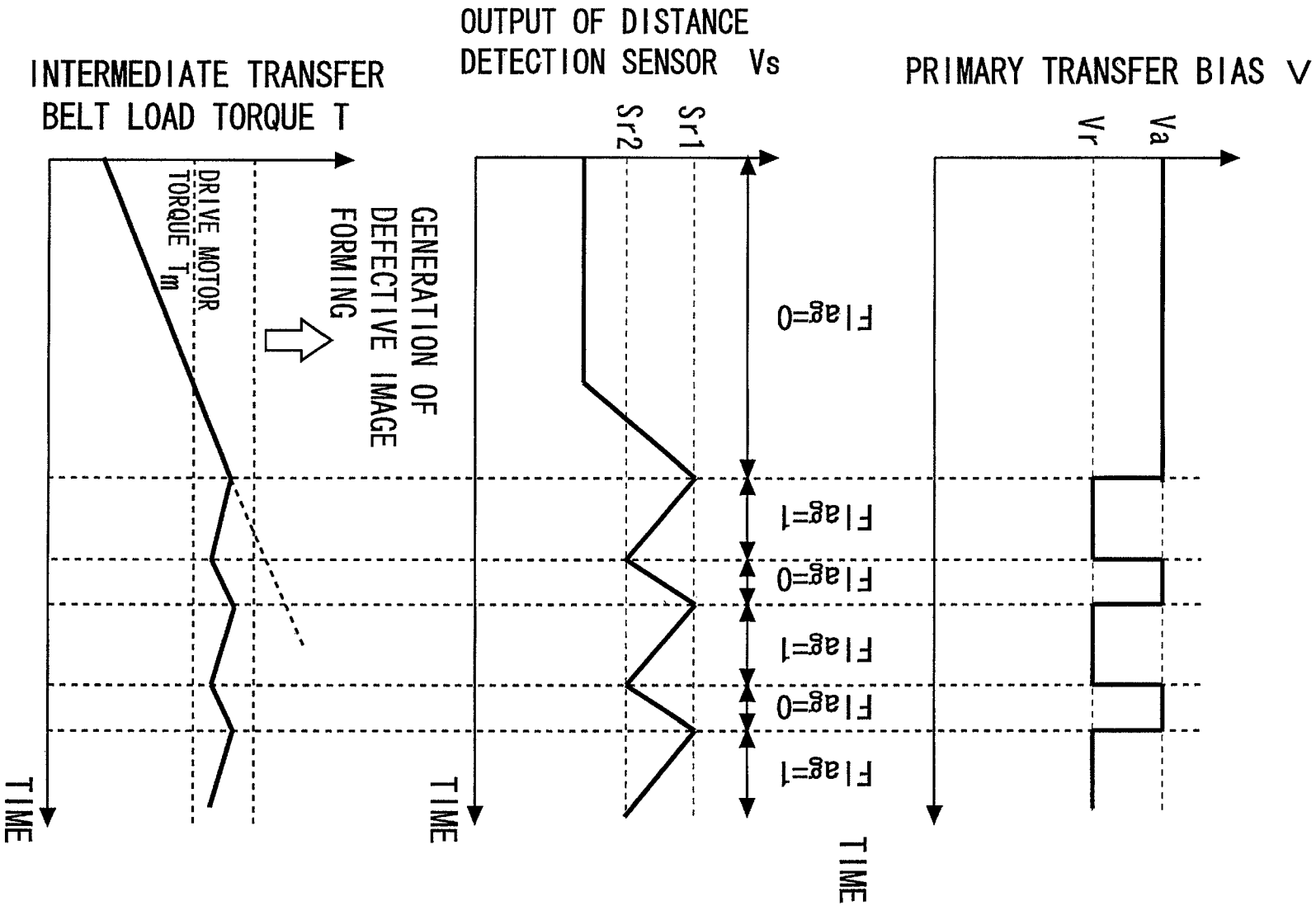
FIG. 1 is a diagram for explaining changes in load torque of an intermediate transfer belt according to a first embodiment of the present invention.

FIG. 1 is a diagram for explaining changes in the load torque of the intermediate transfer belt 228 when the control of the primary transfer bias of this embodiment is executed. As described above, the primary transfer bias is changed sequentially to ATVC control result Va or reduced primary transfer bias Vr based on a detection result of the distance detection sensor 250. As a result, when the image formation operation is performed, the load torque T of the intermediate transfer belt 228 does not exceed the drive motor torque which is a defective image forming generation limit originating from generation of the loop in the intermediate transfer belt 228. Consequently, the color deviation originating from the loop of the intermediate transfer belt 228 or any defective image forming originating from a contact of the curved intermediate transfer belt 228 with any member in the apparatus can be prevented.

According to this embodiment, when the reduced primary transfer bias Vr is selected as the primary transfer bias, a bias different from the ATVC control result is output. Consequently, a slight defective image forming can be generated due to changes in the primary transfer bias depending on various environmental conditions. On the other hand, sometimes the color deviation or defective image forming originating from the increase of the loop of the intermediate transfer belt 228, described in the section about the problems to be solved by the present invention, exceeds a user's allowable range. Therefore, even if the possibility of generation of a slight defective image forming exists, it can be said that the effect of reduction of the defective image formings by carrying out the present invention is large.

This embodiment includes the distance detection sensor 250 for detecting a distance from the intermediate transfer belt 228 and based on a detection result of the distance detection sensor 250, the primary transfer voltage control device controls the primary transfer bias which is a bias voltage to be applied to the primary transfer sheet. As a result, an image forming apparatus having a cheap structure and capable of reducing the defective image formings securely can be provided.

According to this embodiment, the distance detection sensor is disposed between the drive roller 237 and the primary transfer portion on the uppermost stream formed by the photosensitive drum 222 and the primary transfer sheet 227, in a rotation direction of the intermediate transfer belt 228. Under the structure of this embodiment, the loop of the intermediate transfer belt 228 is most often generated between the drive roller 237 and the primary transfer portion which can cause a load torque, because the intermediate transfer belt 228 is rotated such that it is pushed by the drive roller. For the reason, it is effective to dispose the distance detection sensor between the drive roller 237 and the primary transfer portion.

The loop correcting device of this embodiment includes a program for executing the flow chart shown in FIG. 5. In the program for executing the flow chart shown in FIG. 5, the processing for actually controlling the primary transfer bias to be applied to the first transfer means as well as the processing of S515 is executed by means of the electrostatic attraction force control device. For example, the electrostatic attraction force control device includes a power supply circuit for applying the primary transfer bias to the primary transfer sheet and the primary transfer voltage control device for controlling the magnitude of the bias (voltage) which the primary transfer power supply circuit outputs.

The range of the loop amount of the intermediate transfer belt 228, which sets the output value Vs of the distance detection sensor 250 in a range between Sr1 and Sr2, corresponds to the predetermined range of the loop amount in this embodiment.

Embodiment 2

Next, Embodiment 2 of the present invention will be explained. Here, those features in Embodiment 2 which are different from Embodiment 1 will be explained. In Embodiment 1, such an example where distance detection sensor 250 is uniquely disposed in the image forming apparatus to detect increase in loop amount in the intermediate transfer belt 228 is explained. In contrast, in the present embodiment, such an example where primary transfer bias is controlled utilizing an output of the color deviation detection sensor that is provided conventionally for correction of color deviation will be explained.

Figure 6:
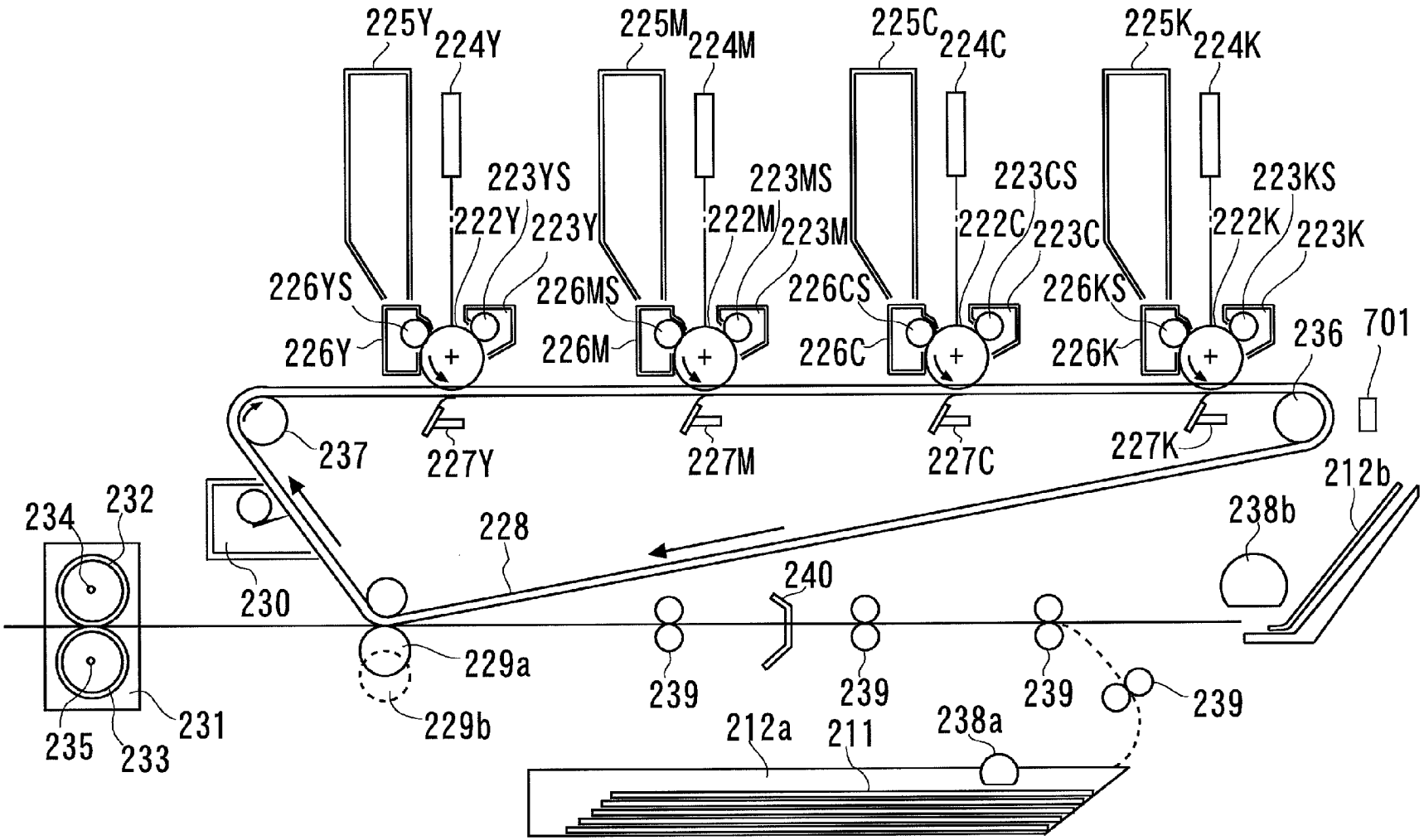
FIG. 6 is a sectional view of the tandem type image forming apparatus employing the intermediate transfer belt which is an example of an electrophotographic image forming apparatus according to a second embodiment of the present invention.

FIG. 6 shows a color image forming apparatus of electrophotographic method in the present embodiment which is equipped with an image forming means relating to four colors of yellow Y, magenta M, cyan C, black K, and FIG. 6 is also a cross-sectional drawing of a color image forming apparatus of tandem type employing the intermediate transfer belt 228. Reference numeral 701 is a color deviation detection sensor for detecting color deviation amount from a toner patch being formed on the intermediate transfer belt 228. In this color image forming apparatus, color deviation of each color is corrected from results of detection of the color deviation detection sensor. Meanwhile, a configuration excluding the color deviation detection sensor 701 in FIG. 6 is equivalent to the configuration explained in FIG. 2. Therefore, the same reference numerals will be used for the configuration equivalent to FIG. 2 and explanation thereof will not be repeated.

Figure 7:
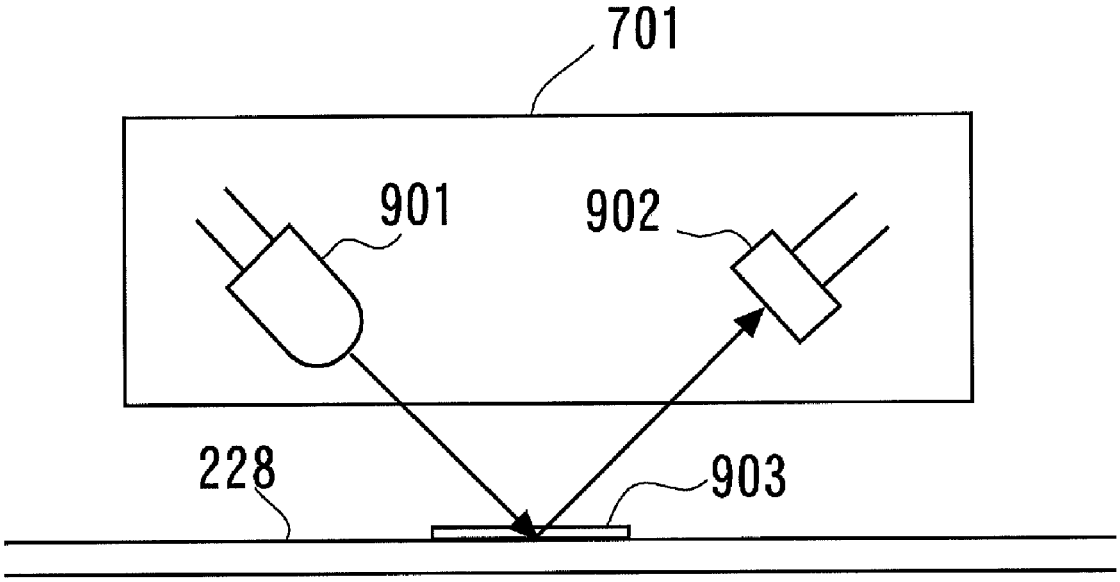
FIG. 7 is a view for explaining an example of the configuration of a color deviation detection sensor according to the second embodiment of the present invention.

FIG. 7 is a drawing explaining one example of a configuration of the color deviation detection sensor 701 which comprises a light emitting device 901 such as an LED, a light receiving device 902 such as photodiode, ICs (not shown) for processing light receiving data, and a holder (not shown) for accommodating these components. The light receiving device 902 detects reflected light intensity from the toner patch 903. Although FIG. 7 has the configuration for detecting normal reflection light from the toner patch 903, detection is not limited to normal reflection light and diffused reflection light may be detected. Meanwhile, use of an optical device such as lens (not shown) is allowed for coupling of the light emitting device 901 and light receiving device 902.

Figure 8:
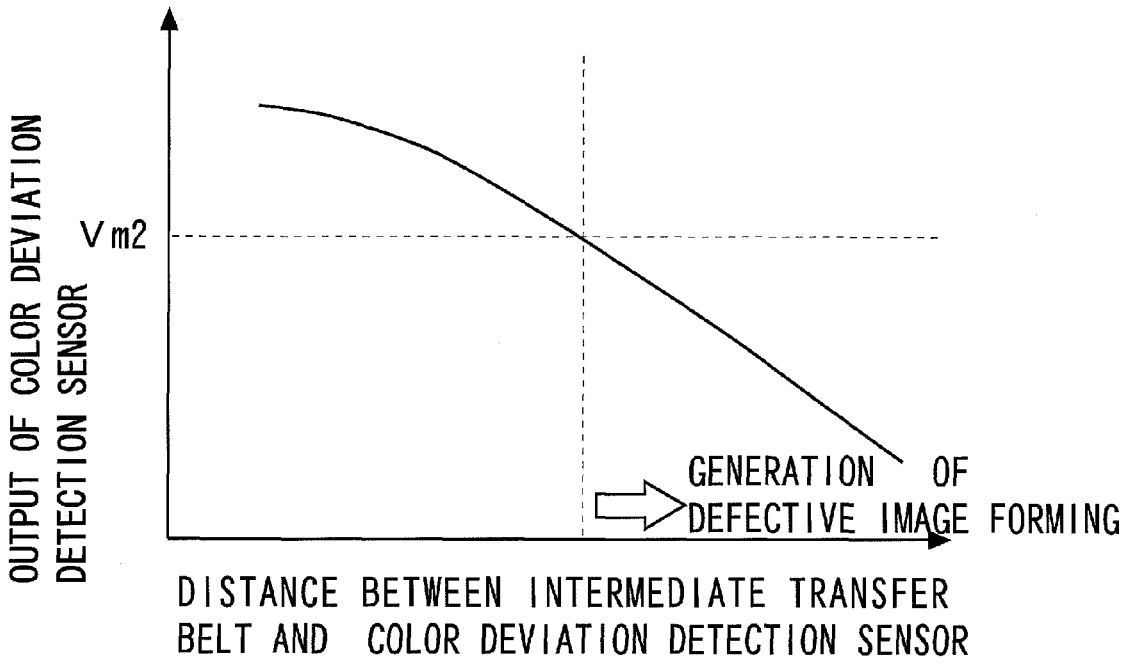
FIG. 8 is a diagram for explaining the output characteristic of a color deviation detection sensor according to the second embodiment of the present invention.

FIG. 8 is a drawing explaining output characteristics of the color deviation detection sensor 701. The color deviation detection sensor 701 has a configuration for detecting position of the intermediate transfer belt 228 in the proximity of a driven roller 236. Therefore, different from the distance detection sensor 250 explained in Embodiment 1, sensor output increases as the intermediate transfer belt 228 comes closer to the color deviation detection sensor 701. Similarly, sensor output decreases as the intermediate transfer belt 228 moves away from the color deviation detection sensor 701. In FIG. 8, output value of the color deviation detection sensor 701 as the threshold, where there is a possibility that loop of the intermediate transfer belt 228 is caused and defective image forming is generated, is defined to be Vm2.

Figure 9:
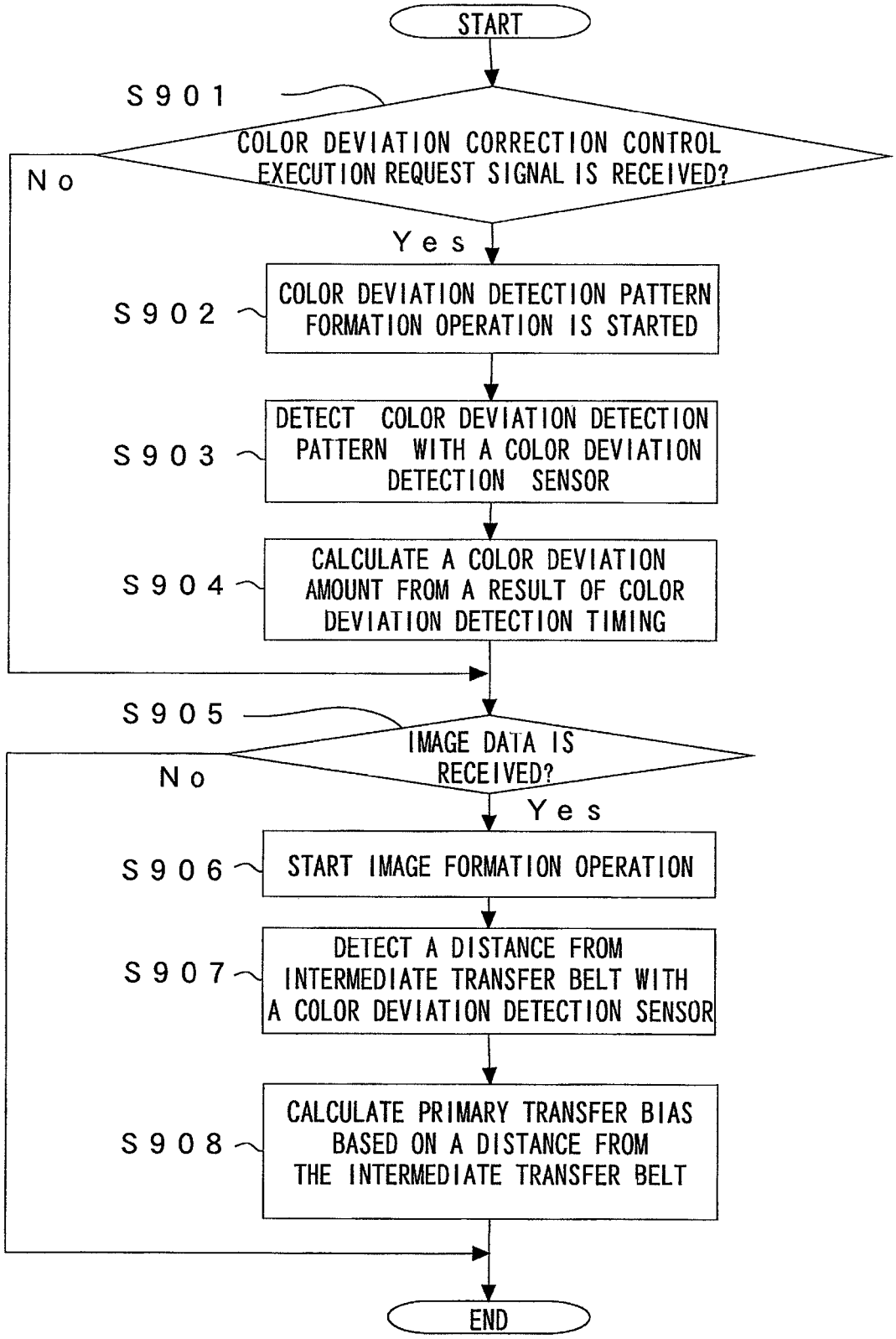
FIG. 9 is a flowchart for explaining an operation of the color deviation detection sensor according to the second embodiment of the present invention.

FIG. 9 is a flowchart explaining operations of the color deviation detection sensor 701 to which the present invention is applicable. In S901, determination is made whether or not the data control portion received an execution demand signal of color deviation correction control. If determined here to be YES, the procedure proceeds to S902. When determined to be NO, the procedure proceeds to S905.

Figure 18:
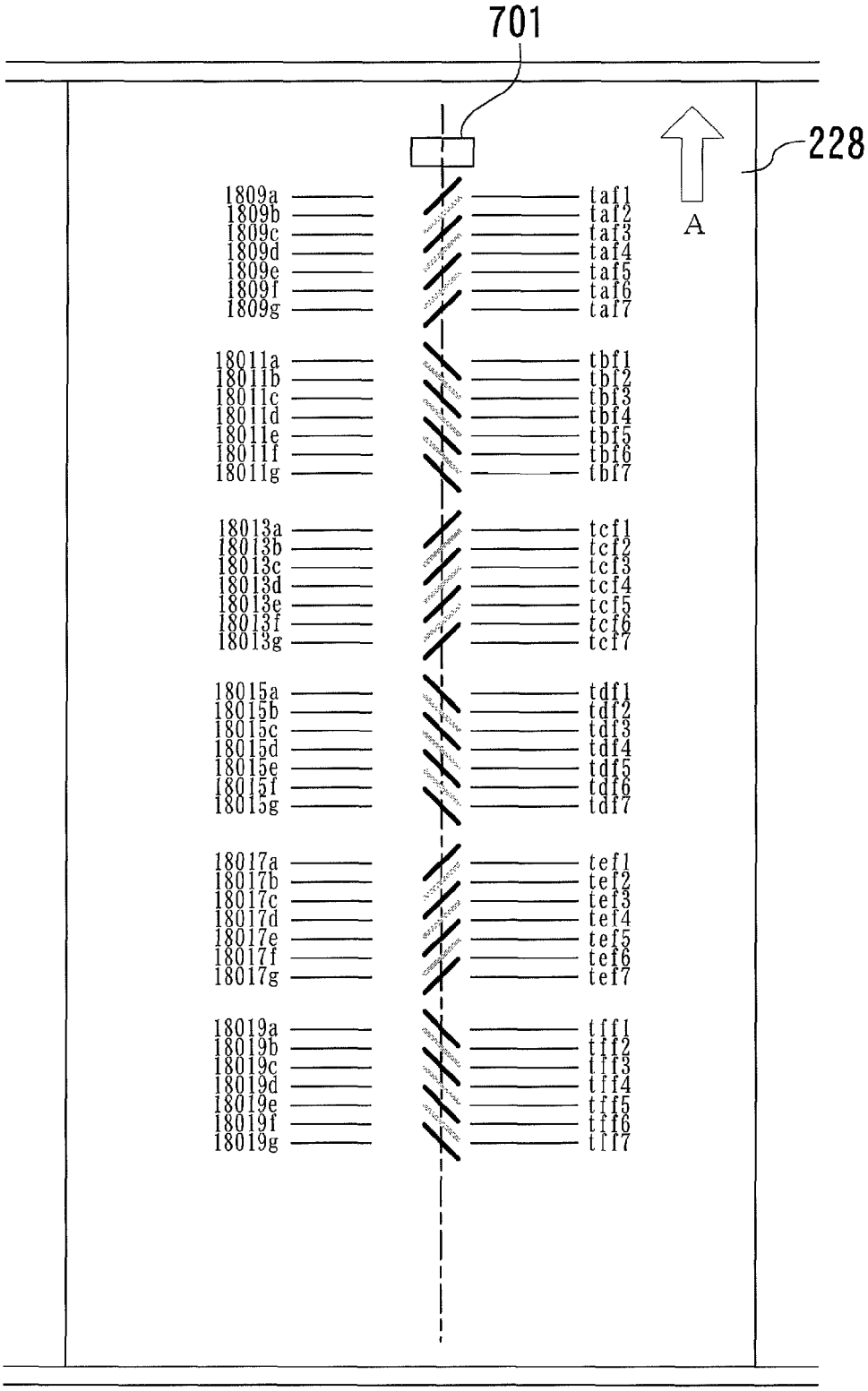
FIG. 18 is a view for explaining an example of a color deviation detection pattern for detecting the color deviation.

In S902, corresponding to the case where the data control portion received execution demand signal of color deviation correction control (YES in S901), pattern forming operation for color deviation detection as shown in FIG. 18 is started. Upon completion of S902 processing, the procedure proceeds to S903.

In S903, a pattern for color deviation detection is detected by the color deviation detection sensor 701. Upon completion of S903 processing, the procedure proceeds to S904.

In S904, based on the results of detection timing of the color deviation detection pattern being detected in S903, color deviation amount with regard to the reference color is calculated. Upon completion of S904 processing, the procedure proceeds to S905.

In S905, determination is made whether or not the controller received the image data being transmitted from the video controller or the like (not shown). If determined to be YES, the procedure proceeds to S906. When determined to be NO, the present routine is once completed as it is.

In S906, corresponding to that the controller received the image data (YES in S905), an image forming operation is started. In this case, papers loaded on paper feeding cassette 212*a* or paper feeding tray 212*b*, that is a paper feeding port specified by the video controller or control panel, or the like, are fed by paper feeding rollers 238*a* or 238*b*. Upon completion of processing of S906, the procedure proceeds to S907.

In S907, a distance between the color deviation detection sensor 701 and intermediate transfer belt 228 is detected. Since details of distance detection are already explained in FIG. 8, explanation will be omitted here. Upon completion of processing of S907, the procedure proceeds to S908.

In S908, primary transfer bias is calculated based on the distance between the intermediate transfer belt and color deviation detection sensor 701 being detected in S907.

Figure 10:
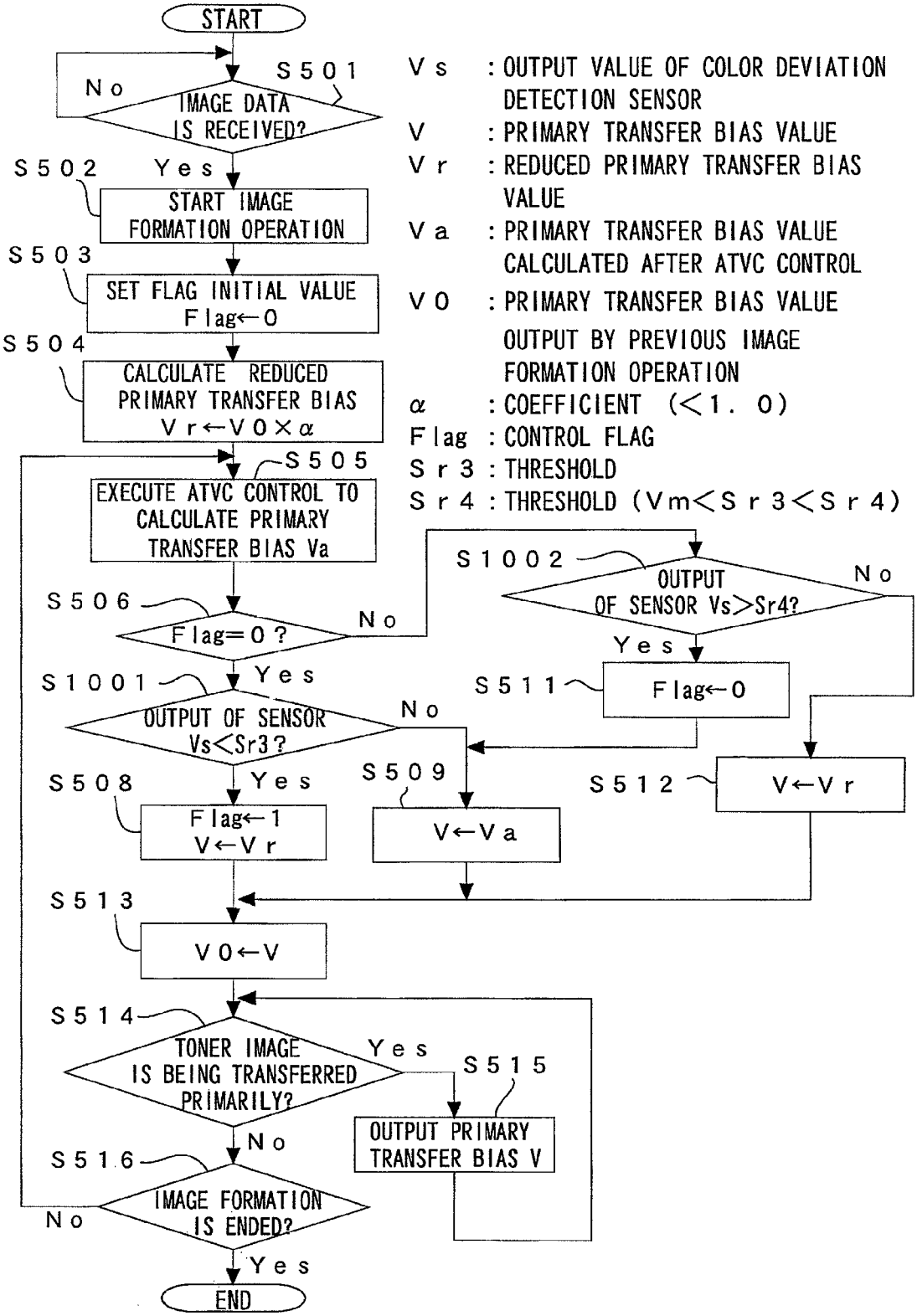
FIG. 10 is a flowchart for explaining an operation of the primary transfer bias control according to the second embodiment of the present invention.

FIG. 10 is a flowchart explaining contents of controls of primary transfer bias in the present embodiment. Since processing from S501 to S506 and S508, S509, and from S511 to S516 are equivalent to those shown in FIG. 5, explanations will be omitted here. In S1001, determination is made whether or not output Vs of the color deviation detection sensor 701 is smaller than Sr3, corresponding to that status of the control flag being 0 (YES in S506).

Here, Sr3 is a threshold set preliminary and detects increase in loop of the intermediate transfer belt 228 more positively, and therefore, it is set in a range of Vm2<Sr3 that is higher than the sensor output value Vm2 when loop amount of the intermediate transfer belt 228 is increased and there is a possibility of defective image forming.

In S1002, determination is made whether or not output Vs of the color deviation detection sensor 701 is greater than Sr4, corresponding to that status of the control flag being 1 (NO in S506). Here, Sr4 is a threshold set preliminary and detects that loop amount of the intermediate transfer belt 228 is reduced sufficiently, and therefore, it is set in a range of Vm<Sr3<Sr4 that is higher than the threshold Sr3 for detecting increase in loop amount of the intermediate transfer belt 228.

Figure 11:
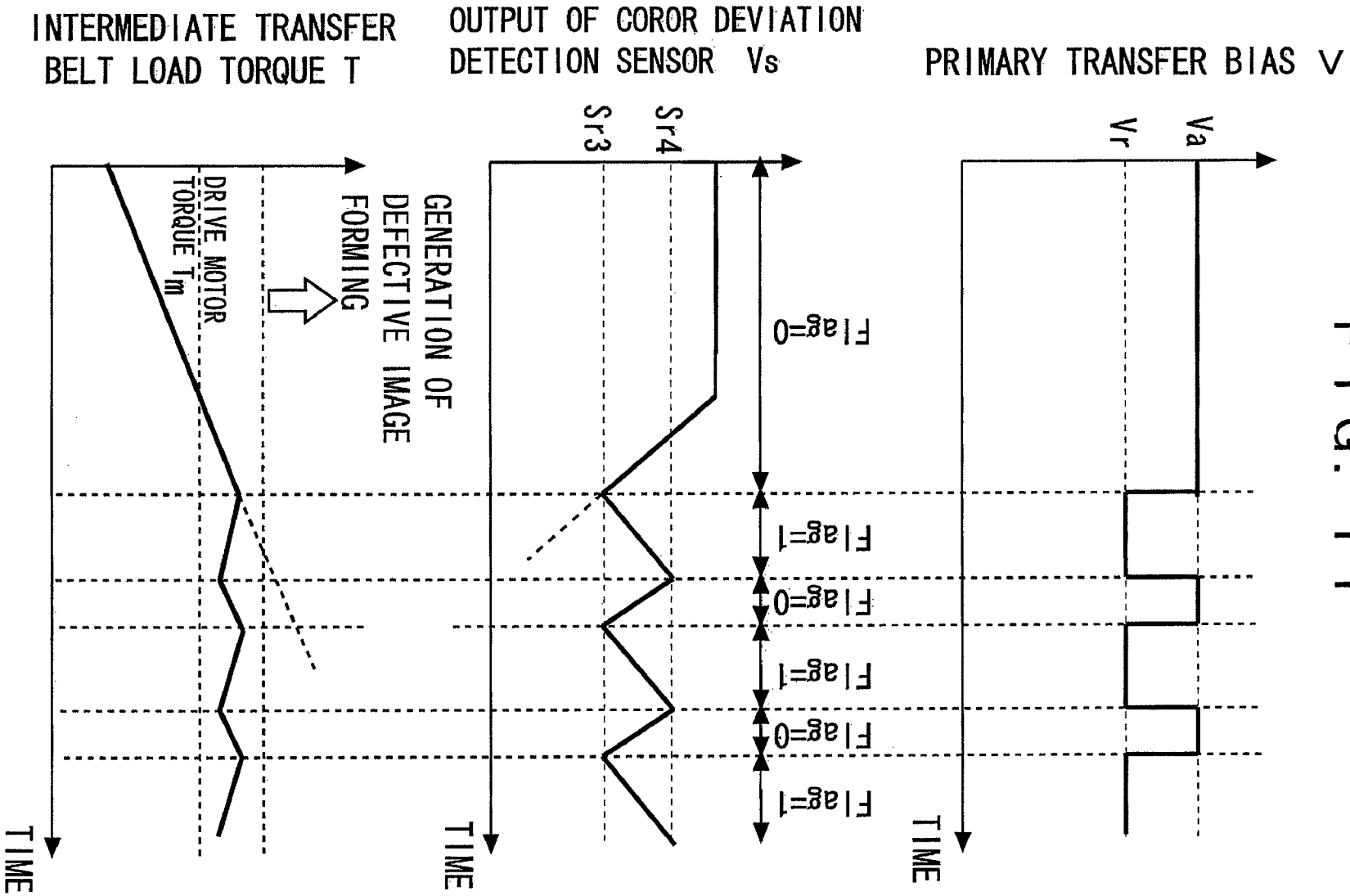
FIG. 11 is a diagram for explaining changes in load torque of the intermediate transfer belt according to the second embodiment of the present invention.

FIG. 11 is a drawing explaining load torque changes of the intermediate transfer belt 228 when image forming operation in the present embodiment is executed on a durability test basis. Based on the results of detection by the color deviation detection sensor 701, primary transfer bias V is changed sequentially to ATVC control result Va or reduced primary transfer bias Vr. As a result, when the image formation operation is performed, the load torque $T_m$ of the intermediate transfer belt 228 does not exceed the drive motor torque $T_m$ which is an defective image forming generation limit originating from generation of the loop in the intermediate transfer belt 228. Consequently, the color deviation originating from the loop of the intermediate transfer belt 228 or any defective image forming originating from a contact of the curved intermediate transfer belt 228 with any member in the apparatus can be prevented.

As mentioned above, in the present embodiment, it is designed that primary transfer bias V is controlled based on the output signal of the color deviation detection sensor 701 which is provided conventionally for correction of color deviation. Accordingly, it is possible to provide an image forming apparatus of less expensive configuration in which defective image formings are reduced more positively without providing newly a special sensor.

Meanwhile, loop correction device in the present embodiment includes a program for executing the flowchart shown in FIG. 10. Of programs for executing the flowchart shown in FIG. 10, processing for actually controlling the primary transfer bias to be applied to the primary transfer member including, for example, S515 processing is executed in the present embodiment by an electrostatic attraction force control device. For example, the electrostatic attraction force control device has a power supply circuit for applying primary transfer bias to the primary transfer sheet and a primary transfer voltage control device for controlling magnitude of bias (voltage) being output by a primary transfer power supply circuit.

Further, a range of curvature amount (loop amount) of the intermediate transfer belt 228 in which output value Vs of the color deviation detection sensor 701 is in a range between Sr3 and Sr4 in the above is corresponding to a predetermined range of the loop in the present embodiment. Further, the color deviation detection sensor 701 in the present embodiment constitutes the detection means.

Embodiment 3

Next, Embodiment 3 of the present invention will be explained. Here, those in Embodiment 3 which are different from Embodiment 1 will be explained. A difference between the present embodiment and Embodiment 1 is that changing of the set level of primary transfer bias V is made instantaneously in Embodiment 1, while in the present embodiment, the primary transfer voltage control device performs changing of the set level of primary transfer bias V in stepwise fashion.

In general, controls of the primary transfer bias are executed while a recording material 211 or toner image is not present in the transfer region. However, due to speeding up of the image forming apparatus of recent electrophotographic method, a time when the recording material 211 or toner image is not present in the transfer region has been becoming shorter. From this, it is difficult at present to execute primary transfer bias controls in the time when the recording material 211 or toner image is not present in the transfer region.

Figure 12:
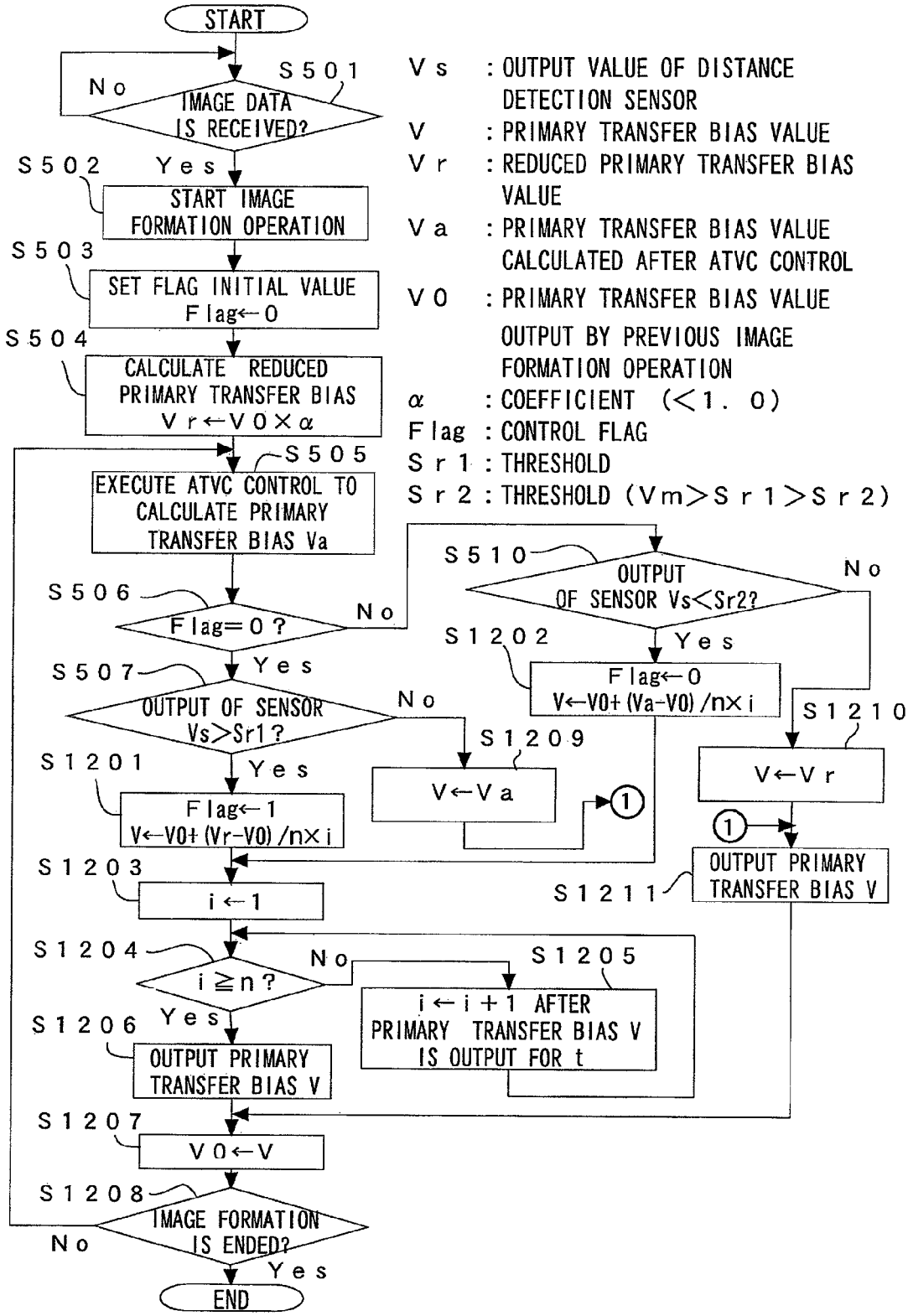
FIG. 12 is a flowchart for explaining the operation of the primary transfer bias control according to a third embodiment of the present invention.

FIG. 12 is a flowchart explaining operations of primary transfer bias controls in the present embodiment. Since processing from S501 to S507 and S510 are equivalent to those shown in FIG. 5 in Embodiment 1, explanations will be omitted here. In S1201, corresponding to that output Vs of the distance detection sensor is greater than Sr1 (YES in step S507), load torque of the intermediate transfer belt 228 increases and loop of the intermediate transfer belt 228 increases, and this is determined to be a state immediately before a possibility of defective image forming is caused. Then, in an attempt to execute reduction control of load torque of the intermediate transfer belt 228, the control flag is set to 1 and the primary transfer bias is set as follows.

$$V=V0+(Vr-V0)/n\times I \tag{4-1}$$

where, n is a step number set arbitrarily, and i is a variable of integer. In the present embodiment, an explanation will be given for a case where n is set to 3 (n=3). Upon completion of the processing of S1201, the procedure proceeds to S1203. In S1203, an initial value 1 is set to variable i. Upon completion of processing of S1203, the procedure proceeds to S1204.

In S1204, determination is made whether or not variable i is n or more. If determined to be YES, i.e., variable i is 3 or more, the procedure proceeds to S1206. Meanwhile, when negative determination is made, i.e., i is less than 3, the procedure proceeds to S1205.

In S1205, corresponding to that variable i is less than 3 (NO in S1204), primary transfer bias V based on Equation (4-1) is output over a predetermined time t. Then, variable i is increased to i+1 upon completion of the output. Upon completion of processing of S1205, it returns before S1204 and executes processing of S1204 again. That is, in S1204 and S1205, in the step where i is increased from 1 to 2, primary transfer bias V corresponding to each value of i is output sequentially over the predetermined time t. When i is determined to be 3 or more in S1204, the procedure proceeds to S1206, and primary transfer bias V corresponding to the case that i=3 is output. When n=3 as a result, primary transfer bias V based on the following Equations (4-2) and (4-3) is output every predetermined time t and reaches finally Vr based on Equation (4-4).

$$V=V0+(Vr-V0)/3\times I \quad (4\text{-}2)$$

$$V=V0+(Vr-V0)/3\times 2 \quad (4\text{-}3)$$

$$V=V0+(Vr-V0)/3\times 3=Vr \quad (4\text{-}4)$$

In this way, primary transfer electrostatic attraction force F and primary transfer portion load F' are reduced in stepwise fashion while primary transfer bias is reduced in stepwise fashion at a state lower than calculated result Va of ATVC control when the control flag is 1. Therefore, it is possible to reduce smoothly load torque of the intermediate transfer belt 228. Here, predetermined time t is a constant which can be set arbitrarily. When t is set smaller, primary transfer bias is reduced more steeply and when t is set greater, primary transfer bias is reduced more slowly. For example, when primary transfer bias control execution is difficult in a time when the recording material 211 is not present in the transfer region, it recommended that t be set greater. Consequently, primary transfer bias changes more slowly and therefore, defective image formings attributable to changes in primary transfer bias can be suppressed even during a time when the recording material 211 is present in the transfer region.

Next, in S1202, control flag is set to 0 and primary transfer bias V is set as follows in an attempt to terminate load torque reduction control of the intermediate transfer belt 228.

$$V=V0+(Va-V0)n\times I \quad (4\text{-}5)$$

This is because it is determined that load torque of the intermediate transfer belt 228 is reduced sufficiently corresponding to that output Vs of the distance detection sensor 250 is smaller than Sr2 (YES in S510). Upon completion of processing of S1202, the procedure proceeds to S1203. Processing from S1203 to S1206 are already explained and therefore, explanations will be omitted here.

Further, in S1209, primary transfer bias V is set to bias Va calculated in ATVC control. This is because it is determined that load torque of the intermediate transfer belt 228 is sufficiently small corresponding to that output Vs of the distance detection sensor 250 is Sr1 or less (NO in S507) and reduction control of the load torque of the intermediate transfer belt 228 is unnecessary. Upon completion of processing of S1209, the procedure proceeds to S1211.

In S1211, primary transfer bias V being set is output to the transfer portion. Following this, after processing of S1211 is completed, the procedure proceeds to S1207 which is explained already. In S1210, it is determined that load torque of the intermediate transfer belt 228 is under reduction control corresponding to that output Vs of the distance detection sensor 250 is Sr2 or more (NO in S510) and primary transfer bias V is set to reduced primary transfer bias Vr. Following this, the procedure proceeds to S1211 as already explained.

In S1207, the value being set as primary transfer bias V is stored as primary transfer bias V0 being output in the previous image forming operation. Upon completion of processing in S1207, the procedure proceeds to S1208.

In S1208, whether or not image forming is completed is determined. When negative determination is made, it returns before the processing of S505. If positive determination is made, the routine is once completed.

Figure 13:
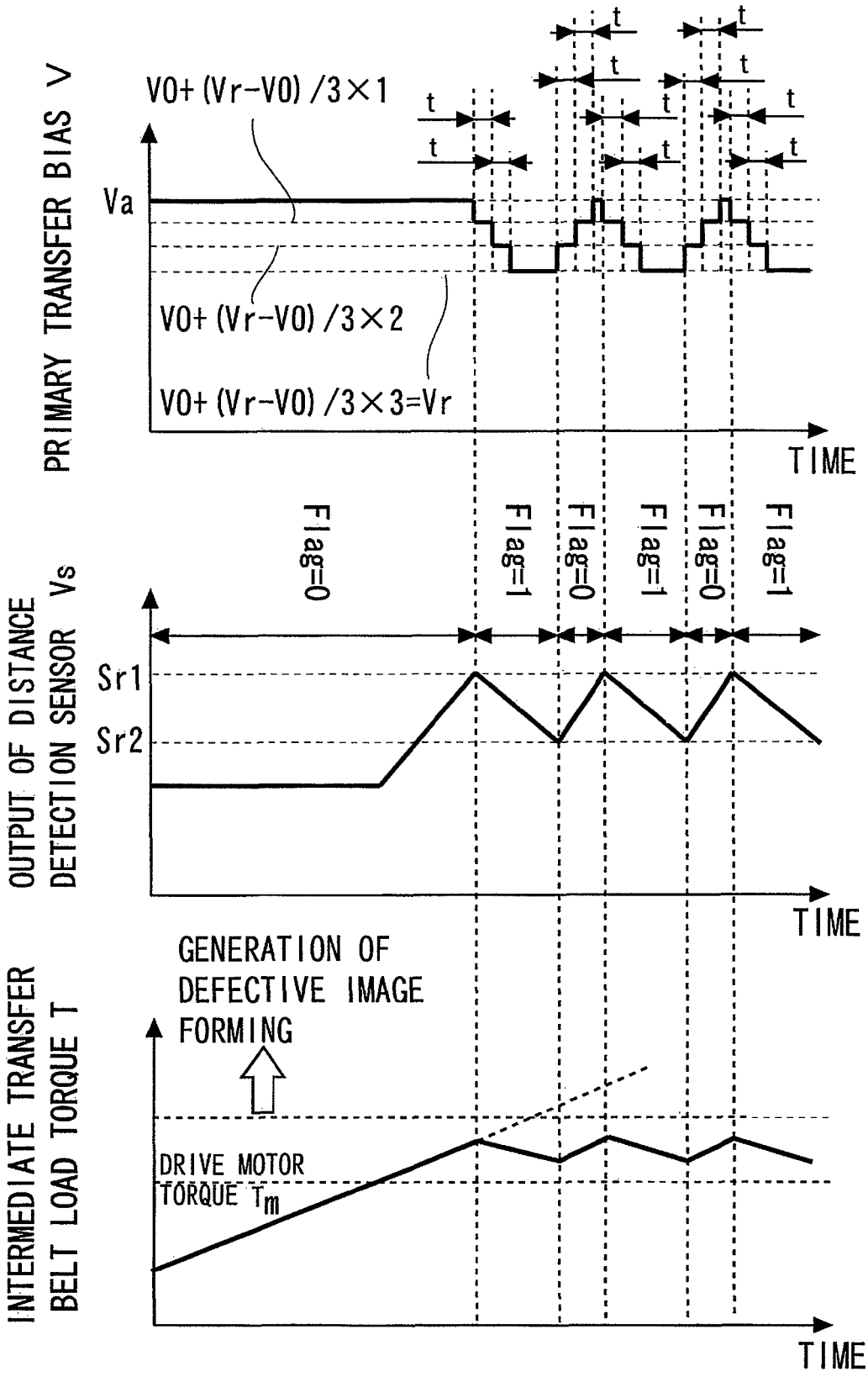
FIG. 13 is a diagram for explaining changes in load torque of the intermediate transfer belt with durable drive according to the third embodiment of the present invention.

FIG. 13 is a drawing explaining load torque changes of the intermediate transfer belt 228 for a case where control of primary transfer bias in the present embodiment is performed. Based on results of detection of the distance detection sensor 250, primary transfer bias V is made closer from either of ATVC control result Va or reduced primary transfer bias Vr to the other in stepwise fashion every predetermined time t. As a result, load torque of the intermediate transfer belt 228 performs image forming operation without exceeding the driving motor torque that is defective image forming occurrence limit due to increase in loop, even in high-speed image forming apparatus in which a time of absence of the recording material 211 and toner image in the transfer region is short. By these manipulations, color deviation resulting from increased loop and defective image forming occurrence resulting from contact of loop to members in the apparatus can be suppressed.

In the present embodiment, there is provided the distance detection sensor 250 for detecting a distance with regard to the intermediate transfer belt 228, and primary transfer bias is controlled in stepwise fashion based on the distance between the intermediate transfer belt 228 and distance detection sensor 250 being detected by the distance detection sensor 250. With this feature, primary transfer bias V can be controlled appropriately even in the high-speed imaging forming apparatus in which a time of absence of the recording material 211 and toner image in the transfer region is short, and occurrence of defective image formings can be suppressed more positively.

Meanwhile, the loop correction device in the present embodiment includes a program for executing the flowchart shown in FIG. 12. Of programs for executing the flowchart shown in FIG. 12, processing for actually controlling the primary transfer bias to be applied to the primary transfer member including, for example, processing of S1211 and S1206 is executed in the present embodiment by an electrostatic attraction force control device. For example, the electrostatic attraction force control device includes a power supply circuit for applying primary transfer bias to the primary transfer sheet and a primary transfer voltage control device for controlling magnitude of bias (voltage) being output by a primary transfer power supply circuit.

Further, although a case where black K is used as the reference color for color deviation correction control is explained in the above-mentioned Embodiment 2, the present invention is of course applicable to the image forming apparatus using other colors as the reference color. Further, although explanations are given using a four-color image forming apparatus in the above-mentioned Embodiments 1 through 3, it is not limited to four colors provided that an image forming apparatus equipped with an endless belt is used. For example, the present invention may be applied to mono-color image forming apparatus equipped with an endless belt.

Further, although explanations are given using a tandem type color image apparatus in the above-mentioned Embodiments 1 through 3, the image forming apparatus to which the present invention is applied is not limited to the tandem type provided that an image forming apparatus equipped with an endless belt is used. For example, rotary type color image forming apparatus equipped with endless belt may be used. Although explanations are given in the above-mentioned embodiments using the image forming apparatus equipped with a primary transfer sheet in sheet-shape, the present invention may be applied to an image forming apparatus equipped with primary transfer roller in roller-shape.

Figure 14:
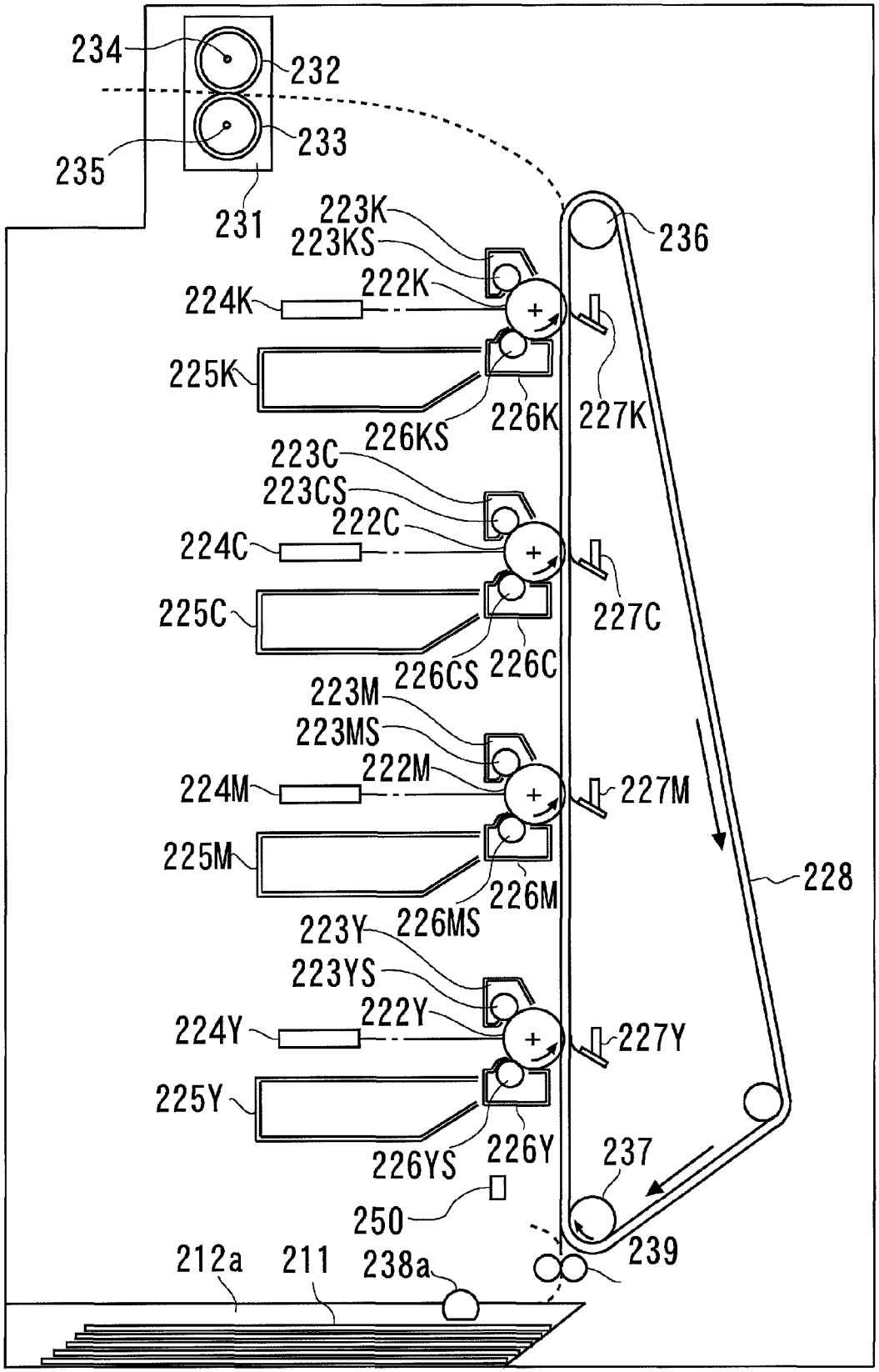
FIG. 14 is a sectional view of the tandem type image forming apparatus employing a sheet conveying belt which is an example of the electrophotographic image forming apparatus according to other embodiment of the present invention.
Figure 15:
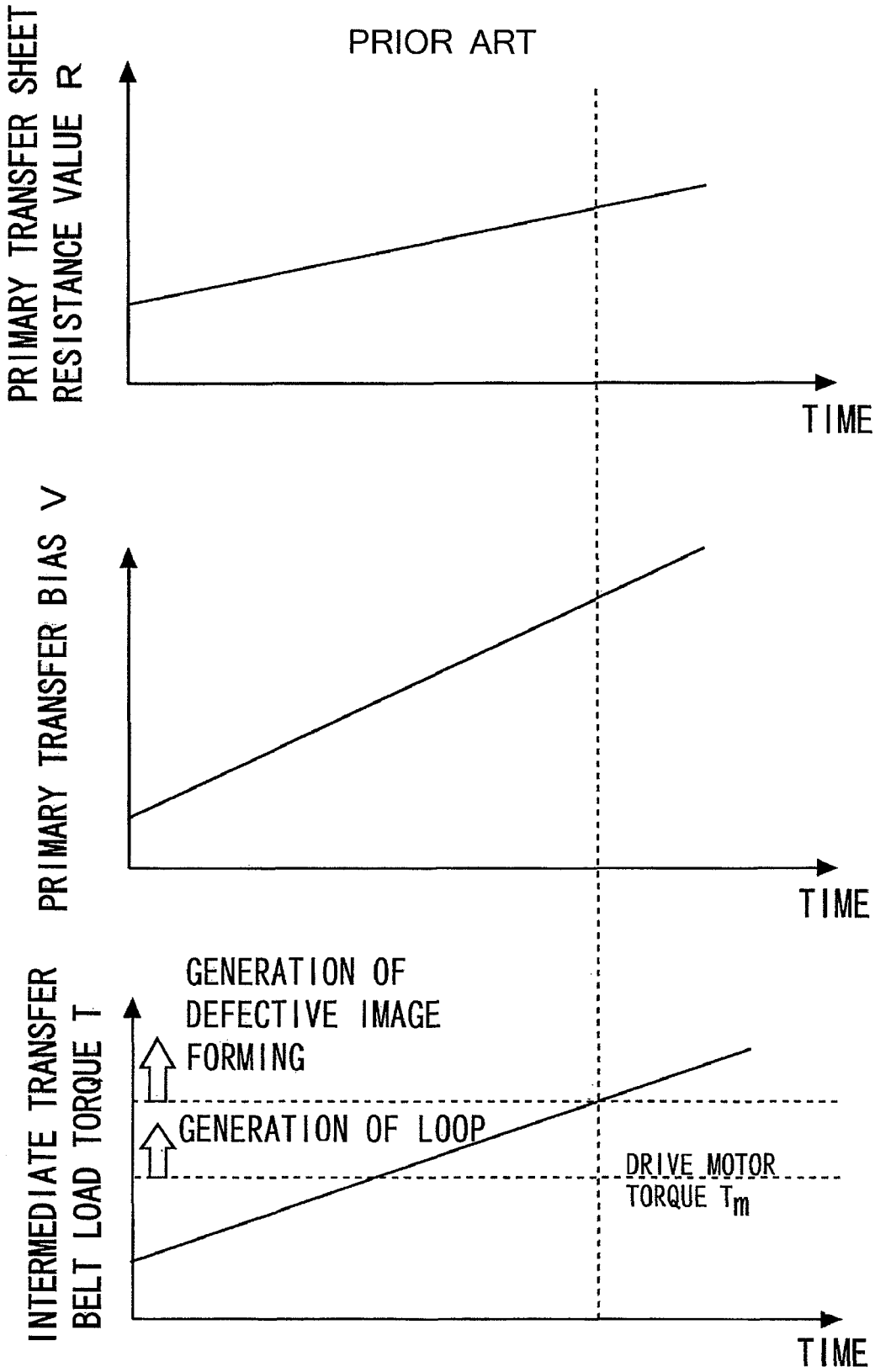
FIG. 15 PRIOR ART
FIG. 15 is a diagram for explaining change in load torque of the intermediate transfer belt based on a prior art.
Figure 16:
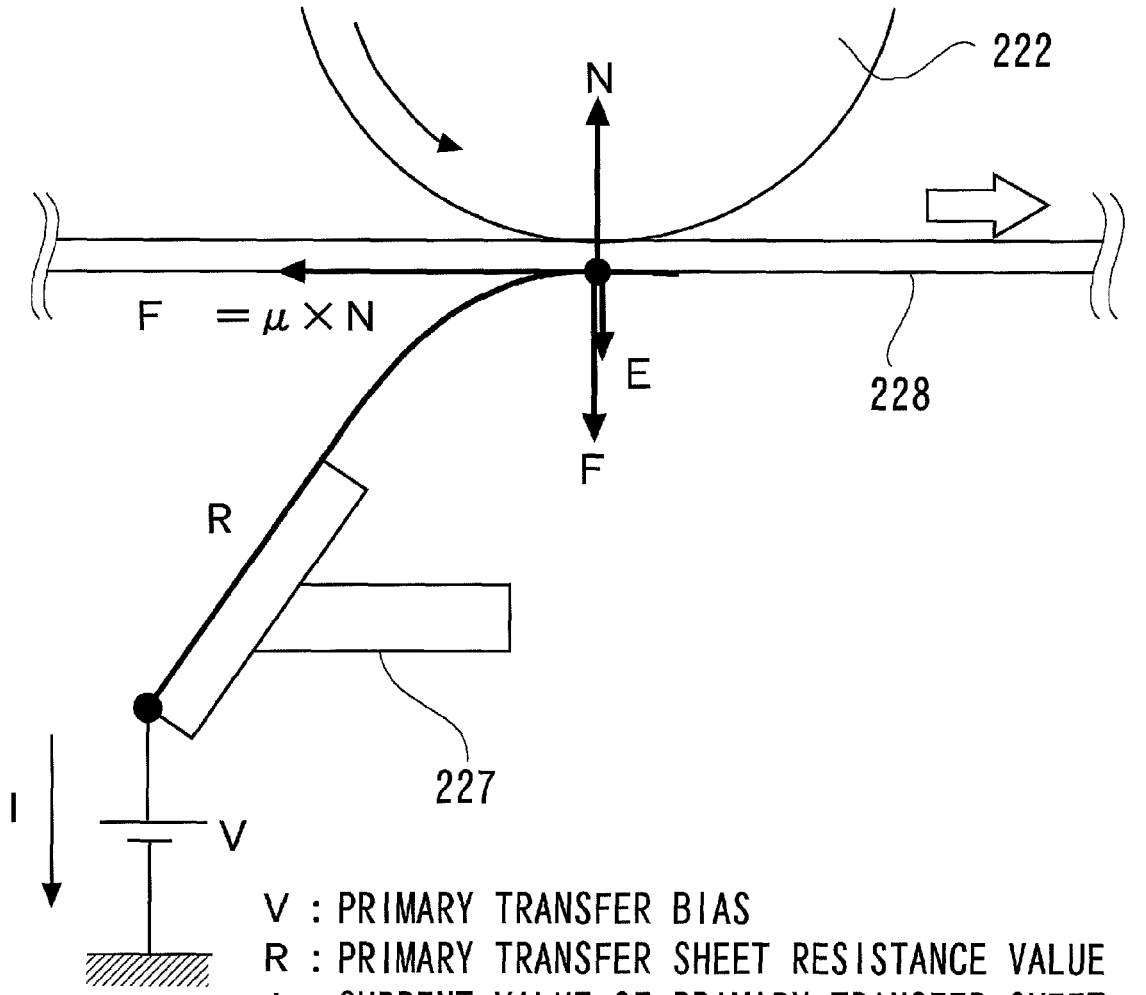
FIG. 16 is a view for explaining a load applied to the primary transfer portion using a primary transfer sheet.
Figure 17:
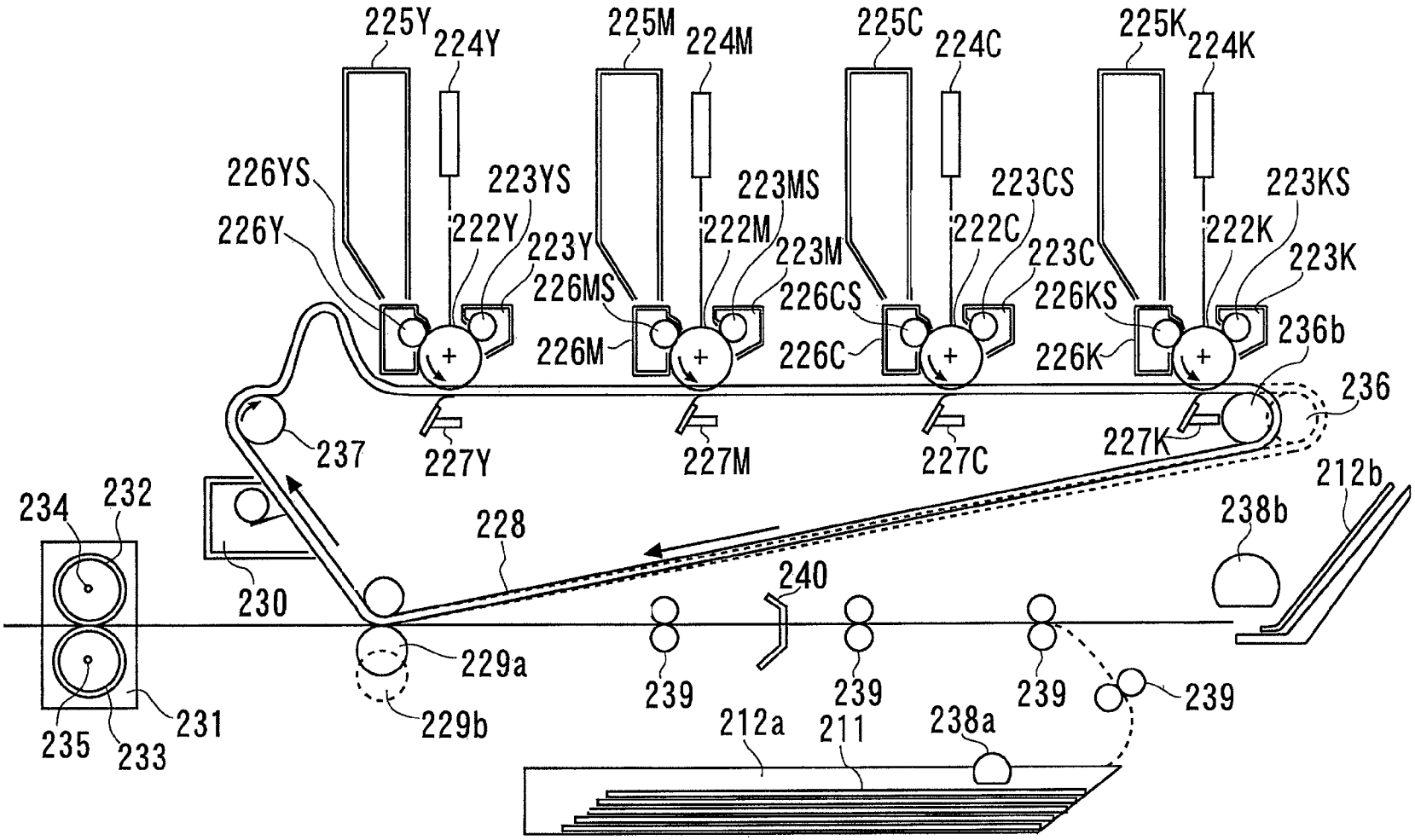
FIG. 17 PRIOR ART
FIG. 17 is a sectional view of an image forming apparatus based on the prior art when the image formation operation of the image forming apparatus is driven durably.

Further, in the above-mentioned Embodiments 1 through 3, explanations are given for the color image forming apparatus in which toner image is primary transferred to the intermediate transfer belt 228 that is an intermediate transfer body in endless-belt-shape and is further transferred on the recording material that is transferred separately using the secondary transfer roller. In contrast, the present invention may be applied to an image forming apparatus in which toner image of an image bearing member is directly transferred on the recording material which is held on a sheet transportation belt as the sheet carrying transportation body in endless-shape as shown in FIG. 14. In other words, the endless belt is not limited to the intermediate transfer belt as the intermediate transfer body and sheet transportation belt as the sheet carrying transportation body may be used.

Further, in the above-mentioned Embodiments 1 through 3, explanations are given for a case where the distance detection sensor 250 for detecting a distance with regard to the intermediate transfer belt 228 is disposed outside the intermediate transfer belt 228. In contrast, the distance detection sensor 250 may be disposed inside the intermediate transfer belt 228 to detect a distance with regard to the intermediate transfer belt 228. Further, although a photosensitive drum is used for the image bearing member in the above-mentioned embodiments, a photosensitive body in belt-shape may be suspended and driven by a driving roller.

Further, in the above-mentioned embodiments, output value of the distance detection sensor 250 for detecting a distance with regard to the intermediate transfer belt 228 or the color deviation detection sensor 701 is compared with the threshold, and control conditions of the primary transfer bias V are determined based on the results of comparison. In contrast, determination may be made by changes of the output value of the distance detection sensor 250 or color deviation detection sensor 701 from image forming operation start (relative difference). For example, when sensor output at image forming operation start is expressed by VsO' and sensor output during image forming operation is expressed by Vs', and when (Vs'−VsO') exceeds a predetermined threshold, primary transfer bias may be controlled to be set to reduced primary transfer bias Vr. With this feature, it is possible to suppress influences of flaw and contamination on the intermediate transfer belt 228 occurred due to operations for long period of time. Therefore, it is possible to detect a distance between the intermediate transfer belt 228 and distance detection sensor 250 or color deviation detection sensor 701 with higher accuracy.

Further, in the above-mentioned embodiments, when determined from the output of the distance detection sensor or color deviation detection sensor there is a possibility of defective image forming occurrence due to loop of the intermediate transfer belt 228, primary transfer bias V is reduced to reduce load torque T of the intermediate transfer belt 228 and to eliminate loop of the intermediate transfer belt 228. In the present invention, in addition to that, when determined there is a possibility of defective image forming occurrence due to loop of the intermediate transfer belt 228, amount of loop may be reduced by increasing the driving motor torque $T_m$. This consideration is also able to suppress defective image formings resulting from increased amount of loop at the intermediate transfer belt 228. In this case, the driving motor torque $T_m$ may be controlled so as to satisfy conditions of Equation (1-4) all the time and to prevent establishment of (1-5) conditions all the time, i.e., controls are made so that loop of the intermediate transfer belt 228 may not occur. With his feature, occurrence of defective image formings resulting from increased loop can be prevented more positively. In this case, the loop correction device executes control programs of the driving motor torque.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-056329, filed on Mar. 6, 2008, which is hereby incorporated by reference herein in its entirety.

What is claimed is:

1. An image forming apparatus, comprising:

an image bearing member for carrying a toner image;

a rotatable endless belt;

a drive roller which supports said endless belt and rotates said endless belt;

a transfer member for transferring a toner image from said image bearing member onto said endless belt or a sheet conveyed by said endless belt electrostatically;

a power supply circuit for applying a voltage to said transfer member;

a transfer voltage control device for controlling the voltage which said power supply circuit applies to said transfer member;

a detecting device which is opposed to said endless belt so as to detect a distance from said endless belt; and a loop correcting device for controlling a loop generated in the endless belt to a predetermined loop amount, wherein said loop correcting device controls the loop of said endless belt to the predetermined loop amount based on the distance detected by said detecting device, by controlling the transfer voltage control device so as to control an electrostatic attraction force of said transfer member to said endless belt.

2. The image forming apparatus according to claim 1, wherein said transfer member comprises a supporting portion and a sliding portion which slides on the inner surface of said endless belt without rotating with respect to said supporting portion.

3. The image forming apparatus according to claim 1, wherein said transfer member comprises a transfer sheet which is adsorbed electrostatically to said endless belt when a voltage is applied.

4. An image forming apparatus, comprising:

an image bearing member for carrying a toner image;

a rotatable intermediate transfer belt to which the toner image is transferred from said image bearing member;

a drive roller which supports said intermediate transfer belt and rotates said intermediate transfer belt;

a primary transfer member which is applied with a voltage so as to transfer the toner image primarily from said image bearing member to said intermediate transfer belt in a primary transfer portion;

a secondary transfer member which is applied with a voltage so as to transfer the toner image secondarily from said intermediate transfer belt to a sheet in a second transfer portion;

a power supply circuit for applying a voltage to said primary transfer member;

a primary transfer voltage control device for controlling a voltage which said power supply circuit applies to said primary transfer member; and a detecting device which is opposed to said intermediate transfer belt so as to detect a distance from the intermediate transfer belt, wherein said primary transfer voltage control device controls a voltage which said power supply circuit applies to said primary transfer member based on a distance detected by said detecting device.

5. An image forming apparatus according to claim 4, further comprising a loop amount determining device for determining the loop amount of said intermediate transfer belt based on the distance detected by said detecting device, wherein said loop amount determining device controls said primary transfer voltage control device so as to eliminate the loop of said intermediate transfer belt.

6. The image forming apparatus according to claim 5, wherein said loop amount determining device controls said primary transfer voltage control device step by step so as to eliminate the loop of said intermediate transfer belt.

7. The image forming apparatus according to claim 4, wherein said primary transfer member comprises a supporting portion and a sliding portion which slides on the inner surface of said intermediate transfer belt without rotating with respect to said supporting portion.

8. The image forming apparatus according to claim 4, wherein said primary transfer member comprises a transfer sheet which is adsorbed electrostatically to said intermediate transfer belt when a voltage is applied.

9. An image forming apparatus, comprising:

an image bearing member for carrying a toner image;

a rotatable sheet conveying belt for conveying a sheet to which the toner image is transferred from said image bearing member;

a drive roller which supports said sheet conveying belt and rotates said sheet conveying belt;

a transfer member which is applied with a voltage so as to transfer the toner image from said image bearing member to the sheet carried by said sheet conveying belt in a primary transfer portion;

a power supply circuit for applying a voltage to said transfer member;

a transfer voltage control device for controlling the voltage which said power supply circuit applies to said transfer member; and a detecting device which is opposed to said sheet conveying belt so as to detect a distance from said sheet conveying belt, wherein said transfer voltage control device controls the voltage which said power supply circuit applies to said transfer member based on a distance detected by said detecting device.

10. The image forming apparatus according to claim 5, further comprising:

a loop amount determining device for determining the loop amount of said sheet conveying belt based on the distance detected by said detecting device, wherein said loop amount determining device controls said transfer voltage control device so as to eliminate the loop of said sheet conveying belt.

11. The image forming apparatus according to claim 10, wherein said loop amount determining device controls said transfer voltage control device step by step so as to eliminate the loop of said sheet conveying belt.

12. The image forming apparatus according to claim 9, wherein said transfer member comprises a supporting portion and a sliding portion which slides on the inner surface of said sheet conveying belt without rotating with respect to said supporting portion.

13. The image forming apparatus according to claim 9, wherein said transfer member comprises a transfer sheet which is adsorbed electrostatically to said sheet conveying belt when a voltage is applied.

* * * * *